US010815087B2

(12) United States Patent
Tsuboi

(10) Patent No.: US 10,815,087 B2
(45) Date of Patent: Oct. 27, 2020

(54) CONVEYOR APPARATUS

(71) Applicant: BROTHER KOGYO KABUSHIKI KAISHA, Nagoya-shi, Aichi-ken (JP)

(72) Inventor: Motohiro Tsuboi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 171 days.

(21) Appl. No.: 15/726,763

(22) Filed: Oct. 6, 2017

(65) Prior Publication Data

US 2018/0099827 A1 Apr. 12, 2018

(30) Foreign Application Priority Data

Oct. 7, 2016 (JP) ..... 2016-198885

(51) Int. Cl.

| | |
|---|---|
| ***B65H 7/06*** | (2006.01) |
| ***B65H 5/38*** | (2006.01) |
| ***B41J 11/00*** | (2006.01) |
| ***B65H 5/06*** | (2006.01) |
| ***B41J 13/00*** | (2006.01) |
| *B41J 2/01* | (2006.01) |

(52) U.S. Cl.

CPC ..... *B65H 5/38* (2013.01); *B41J 11/0095* (2013.01); *B41J 13/0018* (2013.01); *B65H 5/06* (2013.01); *B65H 7/06* (2013.01); *B41J 2/01* (2013.01); *B65H 2511/11* (2013.01); *B65H 2511/514* (2013.01); *B65H 2511/52* (2013.01); *B65H 2511/528* (2013.01); *B65H 2513/512* (2013.01); *B65H 2513/514* (2013.01); *B65H 2701/1311* (2013.01); *B65H 2701/1313* (2013.01)

(58) Field of Classification Search

CPC ... B65H 7/06; B65H 7/02; B65H 7/12; B65H 7/00; B65H 7/04; B65H 7/14; B65H 7/18; B41J 11/0095

See application file for complete search history.

(56) References Cited

U.S. PATENT DOCUMENTS

| | | | | |
|---|---|---|---|---|
| 5,228,680 A * | 7/1993 | Sugiura | B65H 7/04 | 271/259 |
| 6,382,618 B1 * | 5/2002 | Takada | B65H 5/34 | 271/10.01 |
| 8,465,015 B2 * | 6/2013 | Fujiwara | B65H 3/44 | 271/10.03 |

FOREIGN PATENT DOCUMENTS

JP 2007-119213 A 5/2007

* cited by examiner

*Primary Examiner* — Thomas A Morrison
(74) *Attorney, Agent, or Firm* — Scully Scott Murphy and Presser

(57) ABSTRACT

A conveyor apparatus, including: a tray; a feeder; a conveyance path; a conveyor; an upstream sensor; a downstream sensor; and a controller, wherein when it is determined that one certain recording medium has not yet reached a downstream detecting position of the downstream sensor at a time point when a first predetermined time elapses and the trailing edge of the recording medium has passed an upstream detecting position of the upstream sensor, the controller determines that a conveyance error is due to one of: a jam of the recording medium occurred in the conveyance path; and a slippage caused between the conveyor and the recording medium, if a medium length is less than a spacing distance between the upstream and downstream detecting positions while the controller determines that the conveyance error is due to the slippage if the medium length is equal to or larger than the spacing distance.

6 Claims, 9 Drawing Sheets

| | TRAILING EDGE OF SHEET HAS PASSED UPSTREAM DETECTING POSITION | TRAILING EDGE OF SHEET HAS NOT YET PASSED UPSTREAM DETECTING POSITION |
|---|---|---|
| SHEET LENGTH ≥ SENSOR-TO-SENSOR DISTANCE | JAM | FEEDING FAILURE |
| SHEET LENGTH < SENSOR-TO-SENSOR DISTANCE | JAM OR SLIPPAGE | FEEDING FAILURE |

CONVEYOR APPARATUS

CROSS REFERENCE TO RELATED APPLICATION

The present application claims priority from Japanese Patent Application No. 2016-198885, which was filed on Oct. 7, 2016, the disclosure of which is herein incorporated by reference in its entirety.

BACKGROUND

Technical Field

The following disclosure relates to a conveyor apparatus.

Description of Related Art

There is known, as a conveyor apparatus, an image forming apparatus including a feeder (sheet supply roller) configured to feed a recording medium (sheet) stored in a tray (sheet cassette), a conveyor (conveyance roller) configured to receive the recording medium fed by the feeder and to convey the received recording medium along a conveyance path, and a sheet sensor. In the image forming apparatus, feeding is retried when the recording medium does not reach the sheet sensor even though a predetermined time has elapsed from a time point of initiation of the feeding by the feeder.

SUMMARY

The conveyor apparatus may suffer from an error in conveyance of the recording medium (conveyance error) due to various causes. It is required to identify a cause of the conveyance error for appropriate execution of a processing that should be executed after the conveyance error has occurred.

In the known image forming apparatus, the conveyance error described above, in which the recording medium does not reach the sheet sensor even though the predetermined time has elapsed from the time point of initiation of feeding of the recording medium, may be possibly due to a jam of the recording medium occurred in the conveyance path, a slippage caused between the conveyor and the recording medium, etc., in addition to a failure of feeding of the recording medium by the feeder. The image forming apparatus, however, is configured to retry feeding without identifying the cause of the conveyance error when the recording medium does not reach the sheet sensor even though the predetermined time has elapsed from the time point of initiation of feeding of the recording. Thus, the retry of feeding is not necessarily appropriate depending upon the cause of the conveyance error.

Accordingly, an aspect of the disclosure relates to a conveyor apparatus capable of identifying a cause of the conveyance error of the recording medium.

A first aspect of the disclosure relates to a conveyor apparatus, including: a tray configured to store a plurality of recording media; a feeder configured to contact an uppermost recording medium among the plurality of recording media stored in the tray and configured to feed the uppermost recording medium to a conveyance path; a conveyor configured to convey, along the conveyance path, the uppermost recording medium fed by the feeder; an upstream sensor configured to detect presence or absence of the uppermost recording medium at an upstream detecting position in a conveyance direction of the uppermost recording medium, the upstream detecting position being a storage position of the uppermost recording medium among the plurality of recording media stored in the tray which is held in contact with the feeder; a downstream sensor configured to detect presence or absence of the conveyed uppermost recording medium at a downstream detecting position which is downstream of the conveyor in the conveyance direction; and a controller, wherein the controller is configured to execute: a medium-length obtaining processing for obtaining a length of the recording medium stored in the tray in the conveyance direction; a first determining processing in which when one certain recording medium fed to the conveyance path by the feeder is conveyed along the conveyance path, it is determined based on a detection result of the downstream sensor whether the one certain recording medium has reached the downstream detecting position in a time period from a time point of initiation of a feeding operation of the one certain recording medium by the feeder to a time point when a first predetermined time elapses; and a second determining processing in which it is determined based on a detection result of the upstream sensor whether a trailing edge of the one certain recording medium in the conveyance direction has passed the upstream detecting position, which one certain recording medium was held in contact with the feeder at the time point of initiation of the feeding operation, wherein when it is determined in the first determining processing that the one certain recording medium has not yet reached the downstream detecting position at the time point when the first predetermined time elapses and it is determined in the second determining processing that the trailing edge of the one certain recording medium has passed the upstream detecting position, the controller determines that a conveyance error of the one certain recording medium is due to one of: (i) a jam of the one certain recording medium occurred in the conveyance path; and (ii) a slippage caused between the conveyor and the one certain recording medium if the obtained medium length is less than a spacing distance in the conveyance direction between the upstream detecting position and the downstream detecting position while the controller determines that the conveyance error of the one certain recording medium is due to the jam if the obtained medium length is equal to or larger than the spacing distance.

A second aspect of the disclosure relates to a A conveyor apparatus, including: a tray configured to store a plurality of recording media; a feeder configured to contact an uppermost recording medium among the plurality of recording media stored in the tray and configured to feed the uppermost recording medium to a conveyance path; a conveyor configured to convey, along the conveyance path, the uppermost recording medium fed by the feeder; an upstream sensor configured to detect presence or absence of the uppermost recording medium at an upstream detecting position in a conveyance direction of the uppermost recording medium, the upstream detecting position being a storage position of the uppermost recording medium among the plurality of recording media stored in the tray which is held in contact with the feeder; a downstream sensor configured to detect presence or absence of the conveyed uppermost recording medium at a downstream detecting position which is downstream of the conveyor in the conveyance direction; a storage configured to store error information relating to a cause of a conveyance error of the plurality of recording media; and a controller, wherein the controller is configured to execute: a medium-length obtaining processing for obtaining a length of the recording medium stored in the tray in the conveyance direction; a first determining processing in which when one certain recording medium fed to the conveyance path by the feeder is conveyed along the conveyance path, it is determined based on a detection result of the downstream sensor whether the one certain recording medium has reached the downstream detecting position in a time period from a time point of initiation of a feeding operation of the one certain recording medium by the feeder to a time point when a first predetermined time elapses; and a second determining processing in which it is determined based on a detection result of the upstream sensor whether a trailing edge of the one certain recording medium in the conveyance direction has passed the upstream detecting position, which one certain recording medium was held in contact with the feeder at the time point of initiation of the feeding operation, wherein when it is determined in the first determining processing that the one certain recording medium has not yet reached the downstream detecting position at the time point when the first predetermined time elapses and it is determined in the second determining processing that the trailing edge of the one certain recording medium has passed the upstream detecting position, the controller determines that the conveyance error of the one certain recording medium is due to one of: (i) a jam of the one certain recording medium occurred in the conveyance path; and (ii) a slippage caused between the conveyor and the one certain recording medium if the obtained medium length is less than a spacing distance in the conveyance direction between the upstream detecting position and the downstream detecting position while the controller determines that the conveyance error of the one certain recording medium is due to the jam if the obtained medium length is equal to or larger than a predetermined length which is larger than the spacing distance between the upstream detecting position and the downstream detecting position in the conveyance direction, wherein the controller is configured to further execute: a jam determining processing in which when it is determined in the first determining processing that the one certain recording medium has not yet reached the downstream detecting position at the time point when the first predetermined time elapses and it is determined in the second determining processing that the trailing edge of the one certain recording medium has passed the upstream detecting position, the controller determines that the conveyance error of the one certain recording medium is due to one of the jam and the slippage if the obtained medium length is equal to or larger than the spacing distance in the conveyance direction and is less than the predetermined length, and the controller determines whether it is possible to identify, based on the error information stored in the storage, that the conveyance error is due to the jam; a third determining processing in which when it is determined that it is not possible to identify, based on the error information stored in the storage, that the conveyance error is due to the jam, the controller determines whether the one certain recording medium has reached the downstream detecting position in a time period from the time point of initiation of the feeding operation of the one certain recording medium by the feeder to a time point when a second predetermined time elapses, the second predetermined time being longer than the first predetermined time; a first details identifying processing in which the controller determines that the conveyance error is due to the slippage when it is determined in the third determining processing that the one certain recording medium has reached the downstream detecting position in the time period from the time point of initiation of the feeding operation of the one certain recording medium by the feeder to the time point when the second predetermined time elapses and in which the controller determines that the conveyance error is due to the jam when it is determined in the third determining processing that the one certain recording medium has not yet reached the downstream detecting position at the time point when the second predetermined time elapses; and an updating processing in which when it is determined in the first details identifying processing that the conveyance error is due to the jam, the controller updates the error information stored in the storage based on the determination so as to facilitate identification to be made in the jam determining processing that the conveyance error is due to the jam, wherein the controller determines in the jam determining processing whether it is possible to identify, based on the error information updated in the updating processing, that the conveyance error is due to the jam.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF THE EMBODIMENTS

Figure 1:
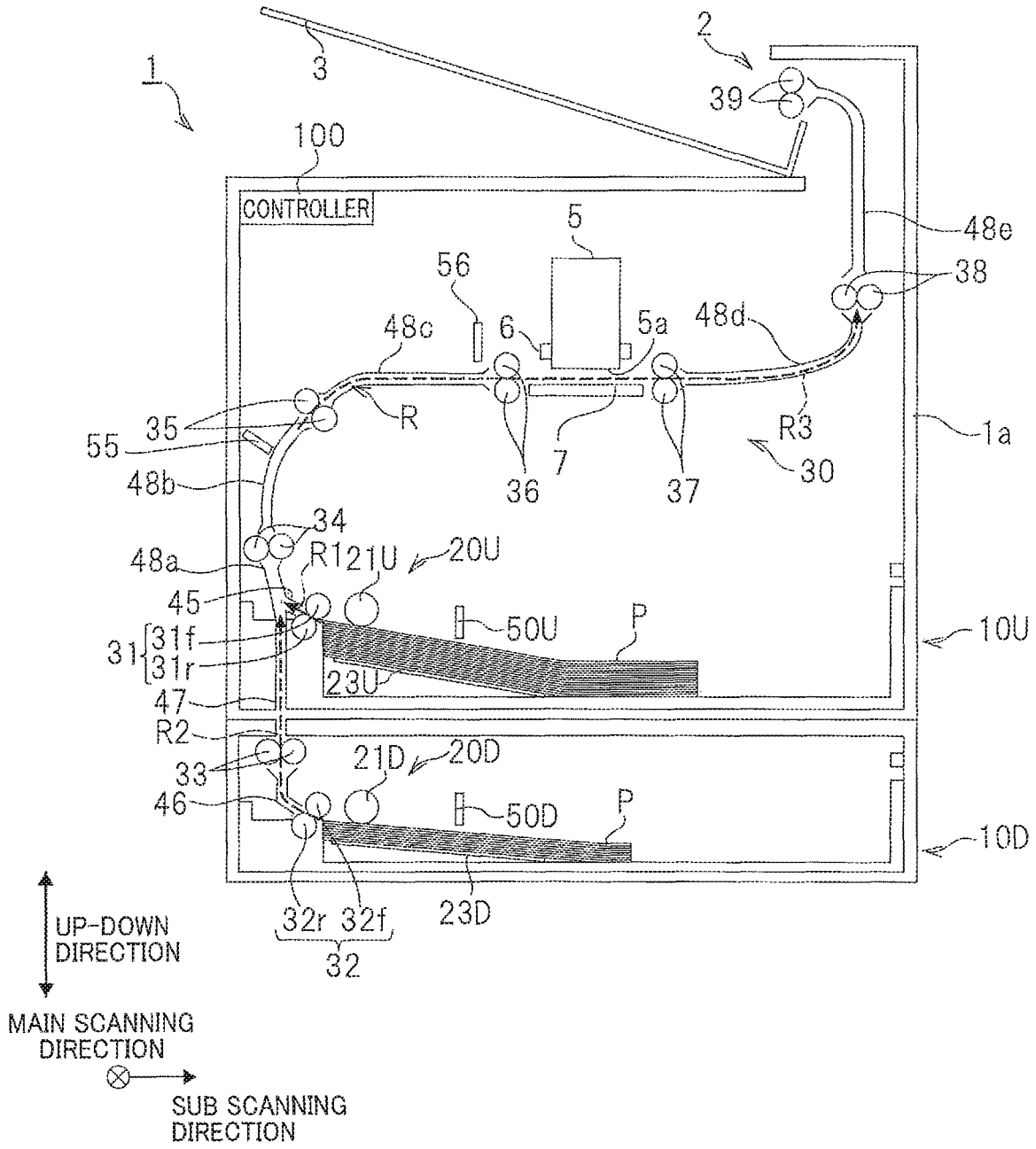
FIG. 1 is a side view schematically showing a mechanical configuration of an ink-jet printer according to one embodiment.

Referring to the drawings, there will be explained an ink-jet printer usable as a conveyor apparatus according to the present disclosure. As shown in FIG. 1, an ink-jet printer 1 (hereinafter referred to as "printer 1") has a housing 1*a* having a rectangular parallelepiped shape. A discharge opening 2 and a sheet-discharge tray 3 are formed on a top plate of the housing 1*a*. The discharge opening 2 is an opening through which a sheet P is discharged from an inside of the housing 1*a* to an outside of the housing 1*a*. The sheet-discharge tray 3 is capable of supporting the sheet P discharged from the discharge opening 2.

A touch panel 4 (FIG. 2) is provided on the housing 1*a*. The touch panel 4 receives various kinds of inputs from a user and enables various setting screens and operation states to be displayed for recognition by the user.

Two sheet-supply trays 10U, 10D stacked in an up-down direction are removably housed in a lower portion of the housing 1*a*. Each of the sheet-supply trays 10U, 10D is shaped like a box opening upward and is capable of storing a stack of a plurality of sheets P. The two sheet-supply trays 10U, 10D are capable of respectively storing the sheets P of different types with mutually different sheet sizes.

There is defined, in the housing 1*a*, a conveyance path R of the sheet P extending from the sheet-supply trays 10U, 10D to the discharge opening 2. The conveyance path R is constituted by three conveyance paths R1-R3. The conveyance path R1 extends from the upper sheet-supply tray 10U and is defined by a guide 45. The conveyance path R2 extends from the lower sheet-supply tray 10D and merges, at its downstream end, with a downstream end of the conveyance path R1. The conveyance path R2 is defined by a guide 46 and a guide path 47 which is formed in the upper sheet-supply tray 10U.

The conveyance path R3 is connected to the downstream end of the conveyance path R1 and the downstream end of the conveyance path R2, and extends to the discharge opening 2. That is, the conveyance path R3 is a common conveyance path which is common to the two sheet-supply trays 10U, 10D. The conveyance path R3 is defined by guides 48*a*-48*e*. In the following explanation, a direction from the sheet-supply trays 10U, 10D to the discharge opening 2 in the conveyance paths R1-R3 will be referred to as "conveyance direction".

In addition to the sheet-supply trays 10U, 10D, there are housed in the housing 1*a*, a head 5, s cartridge (not shown) from which black ink is supplied to the head 5, two feeding mechanisms 20U, 20D, a conveyor mechanism 30, two sheet remaining-amount detecting sensors 50U, 50D, two sheet sensors 55, 56, and a controller 100 for controlling devices of the printer 1.

The head 5 is a line head having a generally rectangular parallelepiped shape that is long in a main scanning direction (which will be described). The lower surface of the head 5 functions as an ejection surface 5*a* in which a plurality of ejection openings are formed for ejecting the black ink. The head 5 has flow passages formed therein through which the black ink supplied from cartridge flows and reaches to the ejection openings. The head 5 is fixedly supported by the housing 1*a* through a head holder 6. That is, the printer 1 is a line ink-jet printer configured to perform image recording with the head 5 kept fixed. A platen 7 shaped like a flat plate is disposed below the head 5 so as to be opposed to the ejection surface 5*a*. The platen 7 is for supporting the sheet P. The head holder 6 supports the head 5 such that a predetermined clearance suitable for recording is formed between the head 5 and the platen 7.

Figure 2:
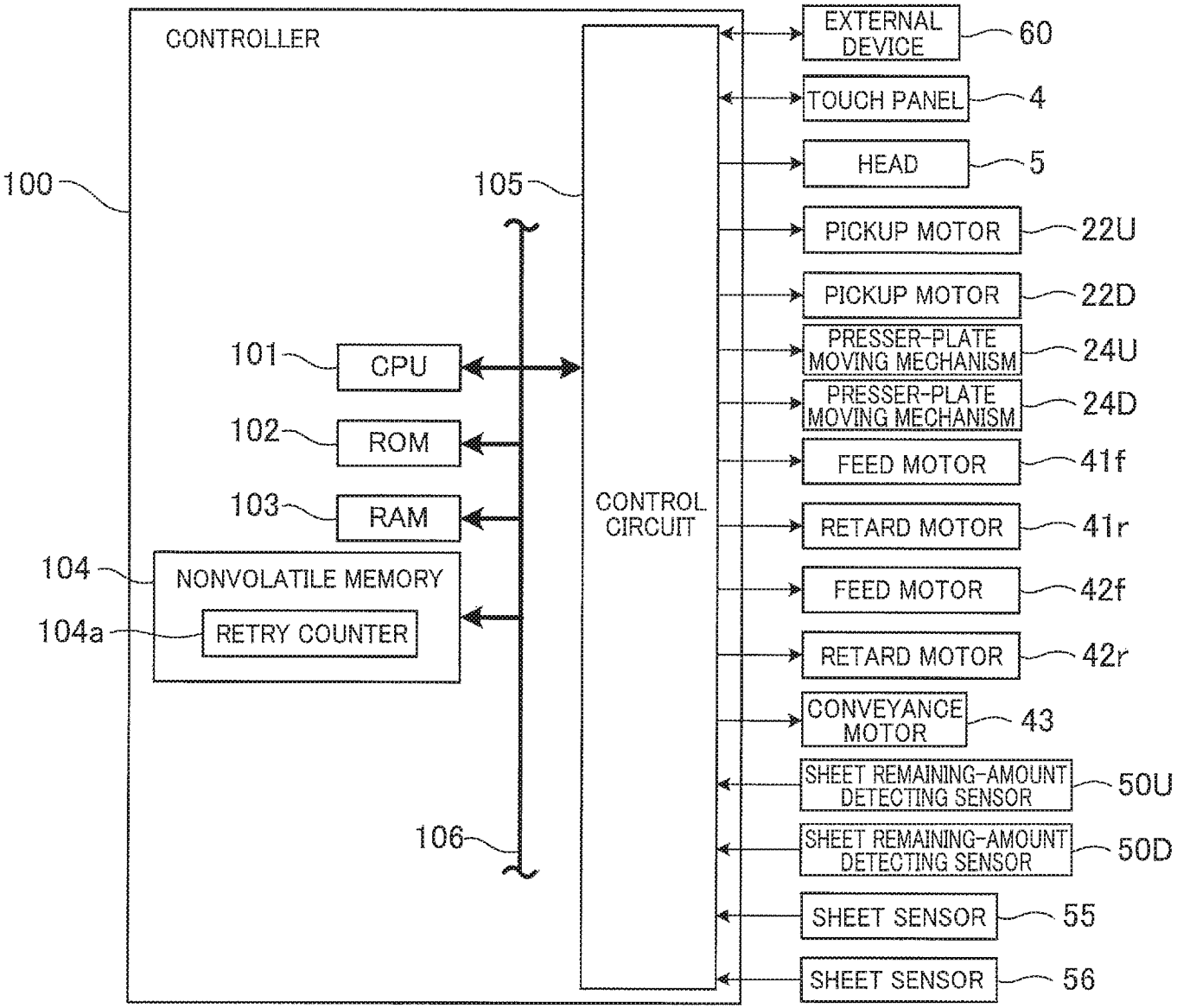
FIG. 2 is a view showing an electrical configuration of the ink-jet printer.

The feeding mechanism 20U is a mechanism for feeding the sheets P stored in the upper sheet-supply tray 10U to the conveyance path R1. The feeding mechanism 20U includes a pickup roller 21U, a pickup motor 22U (FIG. 2) for driving the pickup roller 21U, a presser plate 23U, and a presser-plate moving mechanism 24U (FIG. 2). The pickup roller 21U is in contact with an upper surface of an uppermost sheet P among the plurality of sheets P stored in the sheet-supply tray 10U. Under the control of the controller 100, the pickup roller 21U rotates by being driven by the pickup motor 22U, so as to pick up the uppermost sheet P and feed the uppermost sheet P to the conveyance path R1. The presser plate 23U is a plate on which is placed a front end portion of a stack of the sheets P stored in the sheet-supply tray 10U (i.e., an end portion of the stack of the sheets P nearer to the pickup roller 21U). The presser plate 23U pivots about a rotation shaft provided at its rear end, whereby a front end of the presser plate 23U can move in the up-down direction. In accordance with a decrease of the sheets P placed on the presser plate 23U (i.e., the sheets P stored in the sheet-supply tray 10U), the presser-plate moving mechanism 24U moves, under the control of the controller 100, the front end of the presser plate 23U upward by an amount corresponding to the decrease of the sheets P. According to this configuration, a contact pressure (sheet-supply pressure) between the uppermost sheet P among the plurality of sheets P stored in the sheet-supply tray 10U and the pickup roller 21U can be kept within a predetermined range, obviating a failure of feeding of the uppermost sheet P by the pickup roller 21U.

The feeding mechanism 20D is a mechanism for feeding the sheets P stored in the lower sheet-supply tray 10D to the conveyance path R2. The feeding mechanism 20D is identical in construction to the feeding mechanism 20U. That is, the feeding mechanism 20D includes a pickup roller 21D, a pickup motor 22D (FIG. 2) for driving the pickup roller 21D, a presser plate 23D, and a presser-plate moving mechanism 24D (FIG. 2). Under the control of the controller 100, the pickup roller 21D rotates by being driven by the pickup motor 22D, so as to pick up an uppermost sheet P among the plurality of sheets P stored in the sheet-supply tray 10D and to feed the uppermost sheet P to the conveyance path R2.

The conveyor mechanism 30 is configured to receive the sheet P fed by the feeding mechanisms 20U, 20D and to convey the received sheet P in the conveyance direction. The conveyor mechanism 30 includes two separation roller pairs 31, 32, seven conveyance roller pairs 33-39, two feed motors 41*f*, 42*f* (FIG. 2), two retard motors 41*r*, 42*r* (FIG. 2), and a conveyance motor 43 (FIG. 2).

When multiple sheets P are fed at once from the feeding mechanisms 20U, 20D, the separation roller pairs 31, 32 separate an uppermost one of the multiple sheets P from the remainder and convey the separated uppermost sheet P. That is, the separation roller pairs 31, 32 is for preventing multiple feeding of the sheets P.

The separation roller pairs 31 are disposed on the conveyance path R1 and include a feed roller 31*f* and a retard roller 31*r*. Under the control of the controller 100, the feed roller 31*f* is driven by the feed motor 41*f* so as to rotate clockwise in FIG. 1, namely, rotates in a direction in which the sheet P is conveyed downstream in the conveyance direction. Under the control of the controller 100, the retard roller 31*r* rotates by being driven by the retard motor 41*r*. The retard roller 31*r* has a torque limiter. When one sheet P is nipped between the retard roller 31*r* and the feed roller 31*f*, the retard roller 31*r* rotates counterclockwise in FIG. 1 by rotation of the feed roller 31*f*. On the other hand, when multiple sheets P are nipped between the retard roller 31*r* and the feed roller 31*f*, the retard roller 31*r* rotates clockwise in FIG. 1. With this configuration, when multiple sheets P are fed from the feeding mechanism 20U, only the uppermost sheet P is separated from the remainder and the separated uppermost sheet P is conveyed to the conveyance path R3.

The separation roller pair 32 is disposed on the conveyance path R2 and include a feed roller 32*f* and a retard roller 32*r*, like the separation roller pair 31. Under the control of the controller 100, the feed roller 32*f* rotates by being driven by the feed motor 42*f*, and the retard roller 32*r* rotates by being driven by the retard motor 42*r*.

Each of the conveyance roller pairs 33-39 includes two rollers which are in contact with each other. Each conveyance roller pair 33-39 is configured to convey the sheet P with the sheet P nipped between the two rollers. One of the two rollers of each conveyance roller pair 33-39 is a drive roller configured to rotate by being driven by the conveyance motor 43 under the control of the controller 100. The other of the two rollers of each conveyance roller pair 33-39 is a driven roller configured to rotate by rotation of the drive roller in a direction opposite to the direction of rotation of the drive roller while being held in contact with the drive roller.

The conveyance roller pair 33 is disposed on the conveyance path R2 so as to be located downstream of the separation roller pair 32 in the conveyance direction. The rotation of the conveyance roller pair 33 permits the sheet P fed from the separation roller pair 32 to be conveyed to the conveyance path R3.

The conveyance roller pairs 34-39 are disposed in this order along the conveyance path R3. The rotation of the conveyance roller pairs 34-39 permits the sheet P fed from the conveyance path R1 and the conveyance path R2 to be conveyed along the conveyance path R3, so that the sheet P is discharged from the discharge opening 2 to the outside of the housing 1*a*. The sheet P discharged from the discharge opening 2 falls onto the sheet-discharge tray 3 and is supported thereon.

The conveyance roller pairs 36, 37 are disposed so as to sandwich the head 5 therebetween in the conveyance direction. The rotation of the conveyance roller pairs 36, 37 permits the sheet P to be conveyed in the horizontal direction while being supported by the platen 7 in a region under the ejection surface 5*a* of the head 5. When the sheet P passes under the head 5 by the rotation of the conveyance roller pairs 36, 37, the ink is ejected to the sheet P from the ejection openings of the head 5 under the control of the controller 100, whereby an image is recorded on the sheet P. A sub scanning direction in FIG. 1 is a direction which is parallel to the conveyance direction of the sheet P by the rotation of the conveyance roller pairs 36, 37 and which is horizontal. The main scanning direction is a direction which is parallel to a horizontal plane and which is orthogonal to the sub scanning direction.

The sheet remaining-amount detecting sensor 50U is disposed above the sheet-supply tray 10U and within a region, in plan view, in which the presser plate 23U is disposed. The sheet remaining-amount detecting sensor 50U is for detecting a remaining amount of the sheets P stored in the sheet-supply tray 10U. The sheet remaining-amount detecting sensor 50U outputs a detection result to the controller 100. In the present embodiment, the sheet remaining-amount detecting sensor 50U measures a position in the up-down direction of an upper surface of the stack of the sheets P stored in the sheet-supply tray 10U or measures a distance between the sensor 50U and the upper surface of the stack of the sheets P, so as to detect the remaining amount of the sheets P from the measurement result. As the sheet remaining-amount detecting sensor 50U, a mechanical sensor or an optical sensor is employed. For instance, in an instance where a light reflective optical sensor having a light emitting element and a light receiving element is employed as the sheet remaining-amount detecting sensor 50U, the sensor may be configured to emit light to the upper surface of the stack of the stored sheets P (as a target object for the measurement), measure a distance to the upper surface of the stack of the sheets P based on an amount of light reflected on the upper surface, and detect the remaining amount of the sheets P from the measurement result.

The sheet remaining-amount detecting sensor 50U is configured to detect presence or absence of the sheet P at a detecting position which is a storage position of an uppermost sheet P contacting the pickup roller 21U among the plurality of the sheets P stored in the sheet-supply tray 10U. The detection position of the sheet remaining-amount detecting sensor 50U will be hereinafter referred to as "upstream detecting position". The sheet remaining-amount detecting sensor 50U outputs the detection result to the controller 100. Where the optical sensor is employed as the sheet remaining-amount detecting sensor 50U, the distance to the target object for the measurement by the sheet remaining-amount detecting sensor 50U differs by the thickness of the sheet P between a case in which the sheet P is present at the upstream detecting position and a case in which the sheet P is not present at the upstream detecting position. Thus, the sheet remaining-amount detecting sensor 50U is capable of detecting presence or absence of the sheet P at the upstream detecting position based on the measured distance to the target object. Based on the detection result output from the sheet remaining-amount detecting sensor 50U, the controller 100 determines whether a trailing edge of the uppermost sheet P stored in the sheet-supply tray 10U has passed the upstream detecting position. In the present embodiment, the upstream detecting position of the sheet remaining-amount detecting sensor 50U is located upstream of a contact position of the pickup roller 21U and the sheet P in the conveyance direction. Thus, in a situation in which the trailing edge of the sheet P does not yet pass the upstream detecting position, the sheet P in question is held in contact with the pickup roller 21U.

The sheet remaining-amount detecting sensor 50D is disposed above the sheet-supply tray 10D and within a region, in plan view, in which the presser plate 23D is disposed. The sheet remaining-amount detecting sensor 50D is similar to the sheet remaining-amount detecting sensor 50U. That is, the sheet remaining-amount detecting sensor 50D is for detecting a remaining amount of the sheets P stored in the sheet-supply tray 10D. The sheet remaining-amount detecting sensor 50D is configured to detect presence or absence of the sheet P at a detecting position which is a storage position of an uppermost sheet P contacting the pickup roller 21D among the plurality of sheets P stored in the sheet-supply tray 10D. The detecting position of the sheet remaining-amount detecting sensor 50D will be hereinafter similarly referred to as "upstream detecting position". The sheet remaining-amount detecting sensor 50D outputs the detection result to the controller 100. Based on the detection result of the sheet remaining-amount detecting sensor 50D, the controller 100 determines whether a trailing edge of the uppermost sheet P stored in the sheet-supply tray 10D has passed the upstream detecting position of the sheet remaining-amount detecting sensor 50D.

The sheet sensors 55, 56 are for detecting presence or absence of the sheet P at respective predetermined positions on the conveyance path R3 as detecting positions. Each of the sheet sensors 55, 56 outputs the detection result to the controller 100. For instance, an optical sensor is employed as each of the sheet sensors 55, 56.

The sheet sensor 55 is configured to detect presence or absence of the sheet P at a detecting position on the conveyance path R3 which is located downstream of the conveyance roller pair 34 in the conveyance direction and upstream of the conveyance roller pair 35 in the conveyance direction. The detecting position of the sheet sensor 55 will be hereinafter referred to as "downstream detecting position". The sheet sensor 55 is a sensor for detecting an error in conveyance of the sheet P (conveyance error) occurred between the sheet-supply tray 10U, 10D and the downstream detecting position. The conveyance error of the sheet P will be later explained in detail.

The sheet sensor 56 is configured to detect presence or absence of the sheet P at a detecting position on the conveyance path R3 which is located downstream of the conveyance roller pair 35 in the conveyance direction and upstream of the head 5 in the conveyance direction. The detection result of the sheet sensor 56 is used for determining a start timing of ink ejection from the head 5. Specifically, the controller 100 determines, based on the detection result of the sheet sensor 56, a timing at which the leading edge of the sheet P has reached the detecting position. The controller 100 further determines, as the start timing of ink ejection, a timing at which a predetermined time elapses from the above-indicated timing of reaching of the leading edge of the sheet P to the detecting position. The predetermined time is obtained by dividing a distance between the detecting position of the sheet sensor 56 and the head 5 (specifically, the most upstream ejection opening[s] in the conveyance direction) by a conveying speed of the sheet P.

As shown in FIG. 2, the controller 100 includes a central processing unit (CPU) 101, a read only memory (ROM) 102, a random access memory (RAM) 103, a nonvolatile memory 104, a control circuit 105, and a buss 106. The ROM 102 stores programs to be executed by the CPU 101, various sorts of fixed data, and so on. The RAM 103 temporarily stores data such as image data required upon execution of the programs. The nonvolatile memory 104 includes a retry counter 104*a* for storing a number by which each feeding mechanism 20U, 20D retried a feeding operation. Hereinafter, the number will be referred to as "number of retries". To the control circuit 105, devices or driving portions of the printer 1, such as the head 5 and the motors, are connected. The control circuit 105 is connected to an external device 60 such as a personal computer (PC).

The CPU 101 executes an image recording processing for recording an image or the like on the sheet P based on a printing command sent from the external device 60. In the image recording processing, the CPU101 controls the feeding mechanisms 20U, 20D and the conveyor mechanism 30 so as to execute a conveying processing for conveying the sheet P from the sheet-supply trays 10U, 10D to the discharge opening 2. In this instance, the CPU 101 controls the head 5 so as to execute an ink ejection processing for ejecting the ink in synchronism with the conveyance of the sheet P.

In the present embodiment, the controller 100 is configured such that the processings are executed by the single CPU. The controller 100 may be configured such that the processings are executed by a plurality of CPUs, a single application specific integrated circuit (ASIC), a plurality of ASICs, or a combination of the CPU(s) and a specific ASIC.

There will be next explained detection, by the CPU 101, of the conveyance error of the sheet P in the conveying processing. In the conveying processing, the CPU 101 determines whether the conveyance error of the sheet P has occurred on the conveyance path R from the sheet-supply trays 10U, 10D to the downstream detecting position of the sheet sensor 55, based on the detection result of the sheet sensor 55.

Specifically, the CPU 101 is configured to determine based on the detection result of the sheet sensor 55 whether the leading edge of the sheet P fed by the feeding mechanisms 20U, 20D has reached (or is present at) the downstream detecting position. It is noted that the downstream detecting position of the sheet sensor 55 is fixed and that a distance on the conveyance path R between: the sheet-supply tray 10U or the sheet-supply tray 10D; and the downstream detecting position, over which the sheet P is conveyed, is predetermined. In addition, the CPU 101 is configured to calculate a conveyance speed of the sheet P by the conveyor mechanism 30 based on control details for the conveyance roller pairs 33-39 and the separation roller pairs 31, 32. Thus, the CPU 101 is configured to calculate a time from a time point of initiation of the feeding operation of the sheet P by the feeding mechanism 20U or the feeding mechanism 20D to a time point when the leading edge of the sheet P should reach the downstream detecting position. This time will be hereinafter referred to as "first time".

In the present embodiment, the first time in a case in which the sheet P is fed from the sheet-supply tray 10U by the feeding mechanism 20U is a sum of: a time obtained by the distance (conveyance distance) from the sheet-supply tray 10U to the downstream detecting position by the conveyance speed; and some margin in consideration of a conveyance accuracy or the like. Further, the first time in a case in which the sheet P is fed from the sheet-supply tray 10D by the feeding mechanism 20D is a sum of: a time obtained by the distance (conveyance distance) from the sheet-supply tray 10D to the downstream detecting position by the conveyance speed; and the margin. In the present embodiment, the conveyance distance on the conveyance path R from the sheet-supply tray 10U to the downstream detecting position and the conveyance distance on the conveyance path R from the sheet-supply tray 10D to the downstream detecting position are pre-stored in the nonvolatile memory 104. The CPU 101 is configured to calculate the first time based on the conveyance distances stored in the nonvolatile memory 104 and control details for the conveyance roller pairs 33-39 and the separation roller pairs 31, 32. As a modification, if the conveyance speed of the sheet P is predetermined, the first time in accordance with the conveyance speed may be pre-stored in the nonvolatile memory 104.

The CPU 101 is configured to determine that the conveyance error is occurring when it is determined that the sheet P has not yet reached the downstream detecting position in a time period from a time point of initiation of the feeding operation of the sheet P by the feeding mechanism 20U, 20D to a time point when the first time elapses (hereinafter referred to as "error determining time point").

The cause of the conveyance error includes a jam of the sheet P occurred on the conveyance path R (paper jam), a slippage caused between the conveyor mechanism 30 and the sheet P, a failure of feeding of the sheet P by the feeding mechanism 20U, 20D (feeding failure), and the like. It is noted that processing details that should be executed after the conveyance error has occurred differ depending upon the cause as explained below.

In a case where the cause of the conveyance error is the jam, the jam may become worse if the sheet P continues to be conveyed thereafter by the conveyor mechanism 30.

Accordingly, in the case where the conveyance error is due to the jam, it is necessary to stop conveyance of the sheet P by the conveyor mechanism 30 and to permit a user to remove the sheet P jammed on the conveyance path R.

In a case where the cause of the conveyance error is the slippage, a position of the conveyed sheet P is shifted to a more downstream side in the conveyance direction, as compared with an intended position. Accordingly, in the case where the conveyance error is due to the slippage, it is not necessary to stop conveyance of the sheet P by the conveyor mechanism 30, unlike the case where the conveyance error is due to the jam. In this respect, where the sheet P was being fed by the feeding mechanism 20U, 20D at predetermined time intervals, a distance between the sheet P in question and a sheet P to be successively fed becomes short, causing a risk of an occurrence of the jam. Accordingly, in the case where the conveyance error is due to the slippage, it is necessary to place, in a waiting state, feeding of the successive sheet P by the feeding mechanism 20U, 20D until a necessary sheet-to-sheet distance is ensured.

In a case where the cause of the conveyance error is the feeding failure, the pickup roller 21U, 21D has failed to pick up the sheet P stored in the sheet-supply trays 10U, 10D. That is, the sheet P is kept stored in the sheet-supply tray 10U, 10D without being fed to the conveyance path R. Accordingly, in the case where the conveyance error is due to the feeding failure, the feeding operation of the sheet P by the feeding mechanism 20U, 20D needs to be retried.

As explained above, the processing details that should be executed after the conveyance error has occurred differ depending upon the cause of the conveyance error. It is thus required to identify the cause of the conveyance error for appropriate execution of the processings that should be executed after the conveyance error has occurred.

In the present embodiment, the CPU 101 is configured to execute an error-cause identifying processing for identifying the cause of the conveyance error when it is determined that the conveyance error is occurring. In the error-cause identifying processing, the CPU 101 identifies the cause of the conveyance error based on a spacing distance in the conveyance direction between: the upstream detecting position of the sheet remaining-amount detecting sensor 50U or the upstream detecting position of the sheet remaining-amount detecting sensor 50D; and the downstream detecting position of the sheet sensor 55, a length in the conveyance direction of the sheet P stored in each of the sheet-supply trays 10U, 10D, and the detection result of each of the sheet remaining-amount detecting sensors 50U, 50D.

Referring to FIGS. 3 and 4, there will be explained a method of identifying the cause of the conveyance error executed by the CPU 101 when it is determined that the sheet P fed from the sheet-supply tray 10U by the feeding mechanism 20U is suffering from the conveyance error. In FIGS. 3 and 4, the presser plate 23U is not illustrated and a part of the conveyance path R from the sheet-supply tray 10U to the downstream detecting position is schematically illustrated as a straight path, for the sake of convenience.

Referring first to FIG. 3, there will be explained the method of identifying the cause of the conveyance error in a case where the sheet P stored in the sheet-supply tray 10U is a sheet P1 having a length in the conveyance direction (hereinafter referred to as "sheet length") which is equal to or larger than a spacing distance between the upstream detecting position of the sheet remaining-amount detecting sensor 50U and the downstream detecting position of the sheet sensor 55. This spacing distance will be hereinafter referred to as "sensor-to-sensor distance".

Figure 3A:
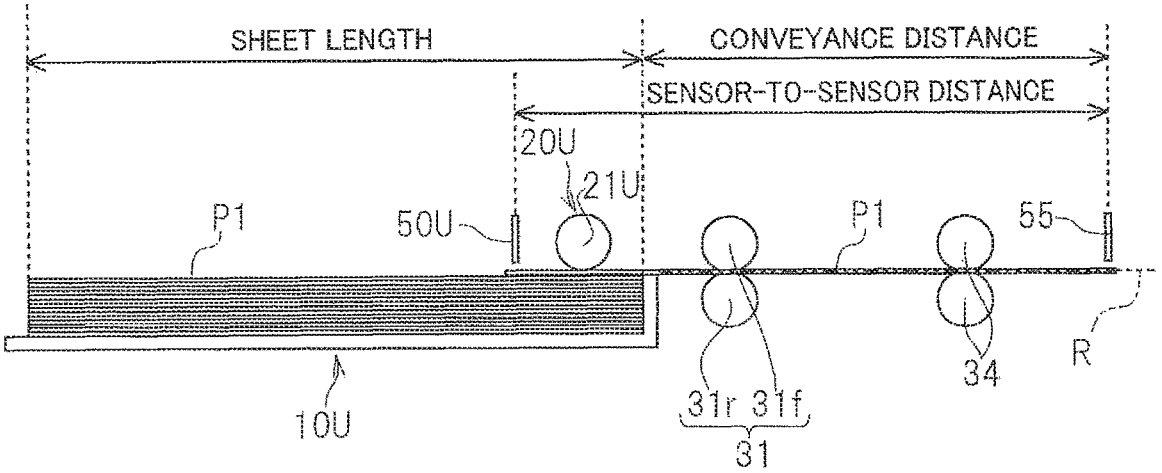
FIGS. 3A-3C are schematic views each for explaining an error occurred in conveyance of a sheet whose length is equal to or larger than a sensor-to-sensor distance, FIG. 3A being a view showing a state in which no conveyance error occurs, FIG. 3B being a view showing a state in which the conveyance error due to a feeding failure occurs, FIG. 3C being a view showing a state in which the conveyance error due to a jam occurs.

As shown in FIG. 3A, in a case where feeding of the sheet P1 by the feeding mechanism 20U and conveyance of the sheet P1 by the conveyor mechanism 30 are normally or properly performed, the leading edge of the sheet P1 reaches the downstream detecting position in a time period from a time point of initiation of the feeding operation of the sheet P1 by the feeding mechanism 20U to a time point when the first time elapses. Because the sheet length of the sheet P1 is equal to or larger than the sensor-to-sensor distance, the trailing edge of the sheet P1 has not yet passed the upstream detecting position at a time point when the leading edge of the sheet P1 reaches the downstream detecting position. As described above, the first time includes some margin added in consideration of the conveyance accuracy or the like. Thus, there may be a case in which the leading edge of the sheet P1 is located downstream of the downstream detecting position in the conveyance direction and the trailing edge of the sheet P 1 has already passed the upstream detecting position, at the time point when the first time elapses from the time point of initiation of the feeding operation.

Figure 3B:
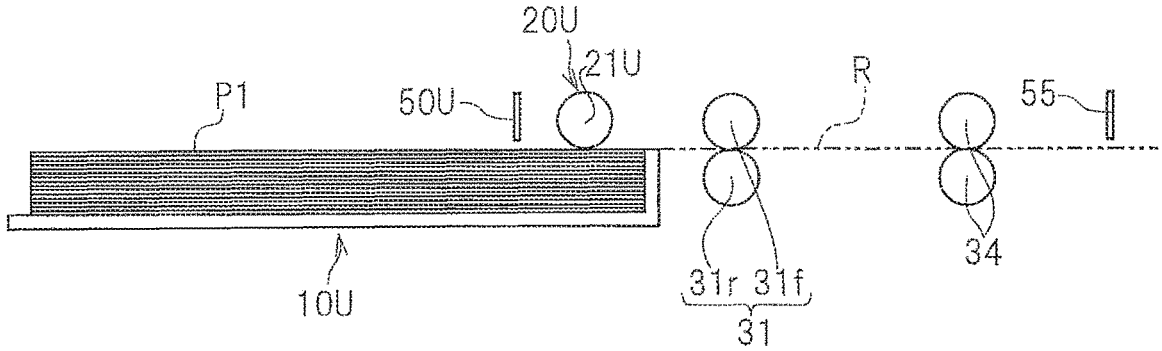
Figure 3C:
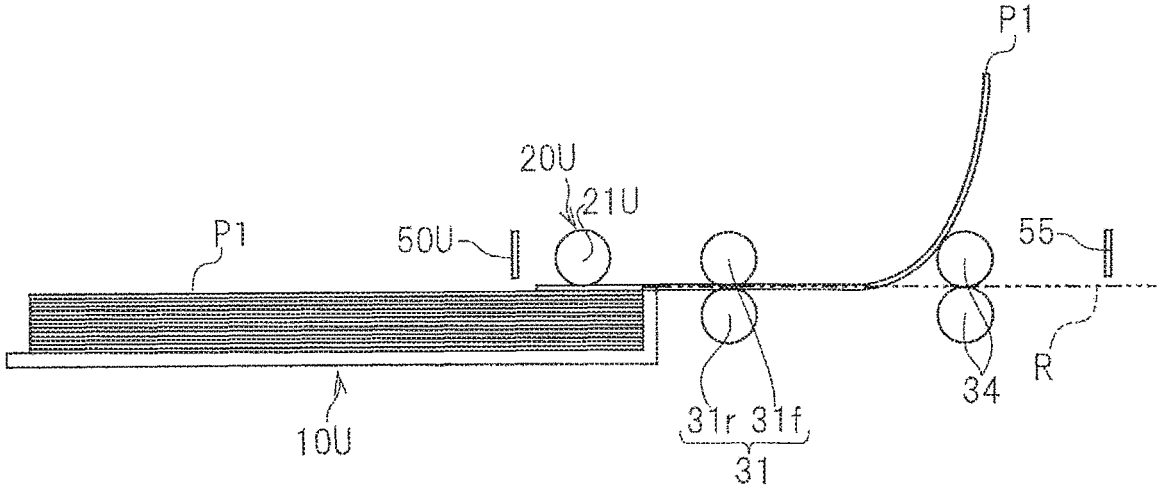
Figures 5, 6:
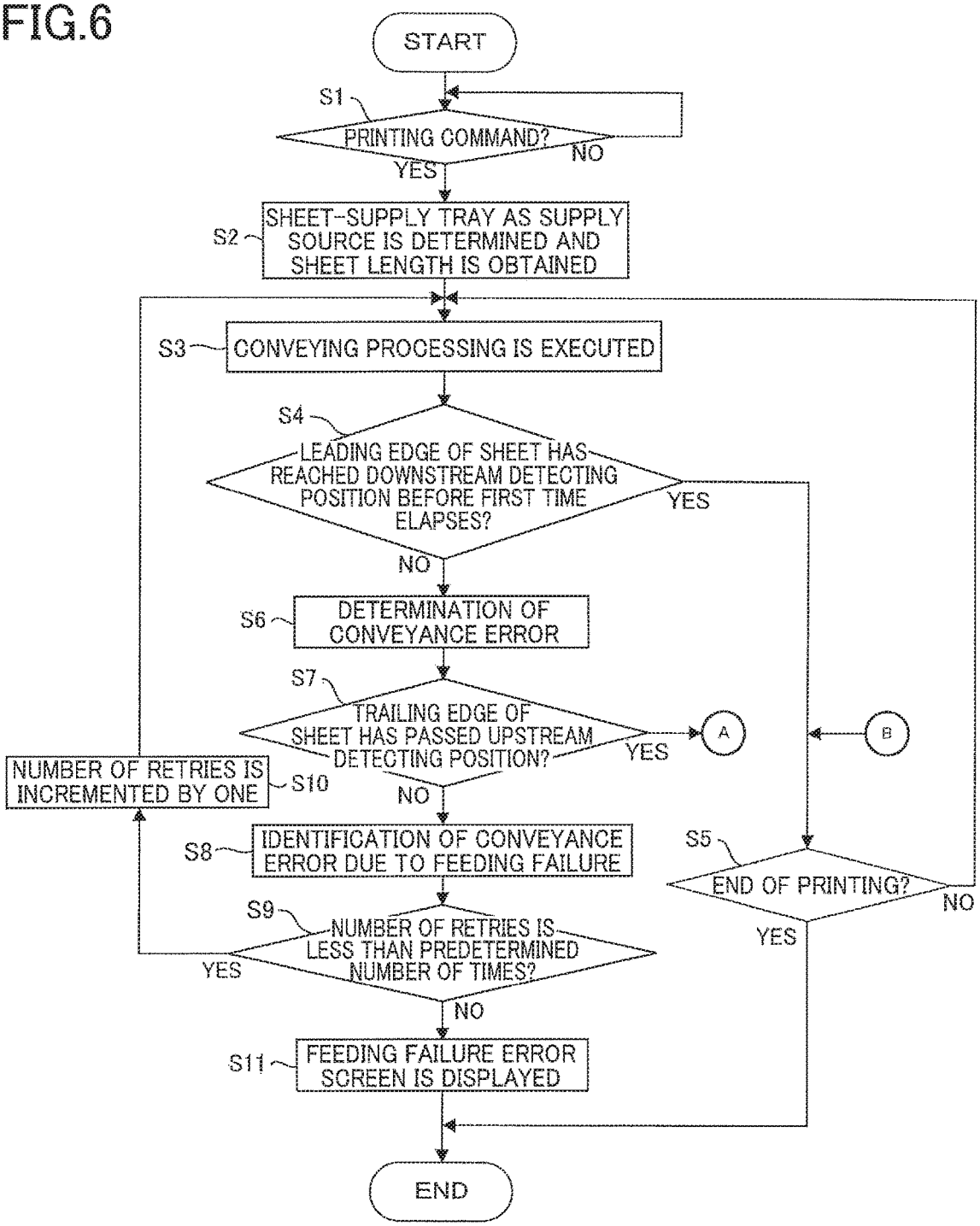
FIG. 5 is a table for explaining causes of the conveyance error of the sheet.
FIG. 6 is a flow chart for explaining an operation of the ink-jet printer.

As shown in FIGS. 3B and 3C, when the conveyance error of the sheet P1 occurs, the leading edge of the sheet P1 has not yet reached the downstream detecting position at the error determining time point which is the time point when the first time elapses from the time point of initiation of the feeding operation of the sheet P1 by the feeding mechanism 20U. If the trailing edge of the sheet P1 has not yet passed the upstream detecting position at this error determining time point, the sheet P1 is still stored in the sheet-supply tray 10U, as shown in FIG. 3B. Accordingly, when the CPU 101 determines at the error determining time point, based on the detection result of the sheet remaining-amount detecting sensor 50U, that the trailing edge of the sheet P1 that was in contact with the pickup roller 21U at the time of initiation of the feeding operation has not yet passed the upstream detecting position, the CPU 101 identifies that the conveyance error of the sheet P1 is due to the feeding failure (FIG. 5). In this respect, there may be a case in which the leading edge of the sheet P1 has actually moved from the sheet-supply tray 10U onto the conveyance path R by being fed by the feeding mechanism 20U. Even in such a case, the trailing edge of the sheet P1 has not yet passed the upstream detecting position, and the sheet P1 is still in contact with the pickup roller 21U. Therefore, it is not problematic to identify that the conveyance error is due to the feeding failure.

On the other hand, if the trailing edge of the sheet P1 has passed the upstream detecting position at the error determining time point, this means that the sheet P1 is present between the upstream detecting position and the downstream detecting position. Because the sheet length of the sheet P1 is equal to or larger than the sensor-to-sensor distance, the sheet P1 is inevitably suffering from flexure or bending between the upstream detecting position and the downstream detecting position on the conveyance path R, as shown in FIG. 3C. Accordingly, when the CPU 101 determines at the error determining time point, based on the detection result of the sheet remaining-amount detecting sensor 50U, that the trailing edge of the sheet P1 has passed the upstream detecting position, the CPU 101 identifies that the conveyance error of the sheet P1 is due to the jam (FIG. 5).

Referring next to FIG. 4, there will be explained the method of identifying the cause of the conveyance error in a case where the sheet P stored in the sheet-supply tray 10U is a sheet P2 having a sheet length less than the sensor-to-sensor distance.

Figure 4A:
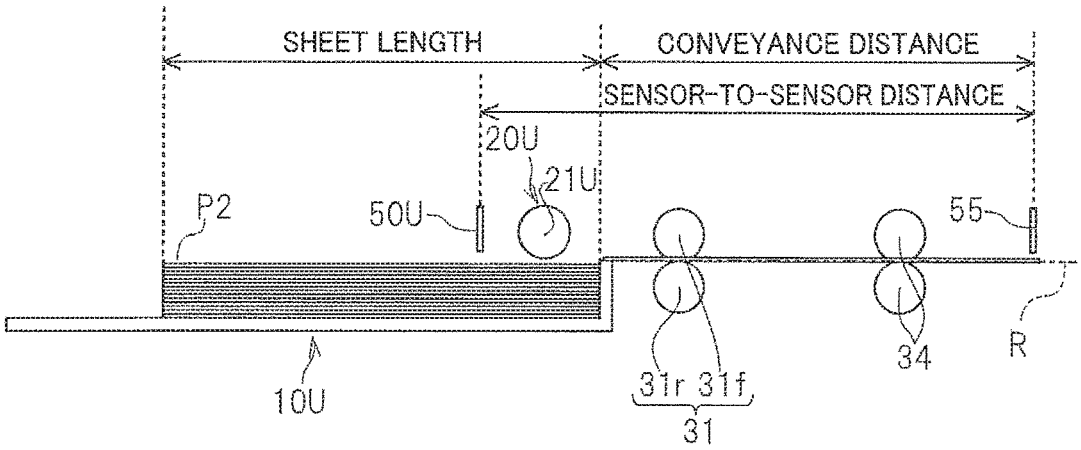
FIGS. 4A-4D are schematic views each for explaining an error occurred in conveyance of a sheet whose length is less than the sensor-to-sensor distance, FIG. 4A being a view showing a state in which no conveyance error occurs, FIG. 4B being a view showing a state in which the conveyance error due to a feeding failure occurs, FIG. 4C being a view showing a state in which the conveyance error due to a jam occurs, FIG. 4D being a view showing a state in which the conveyance error due to a slippage occurs.

As shown in FIG. 4A, in a case where feeding of the sheet P2 by the feeding mechanism 20U and conveyance of the sheet P2 by the conveyor mechanism 30 are normally or properly performed, the leading edge of the sheet P2 reaches the downstream detecting position in a time period from a time point of initiation of a feeding operation of the sheet P2 by the feeding mechanism 20U to a time point when the first time elapses. Because the sheet length of the sheet P2 is less than the sensor-to-sensor distance, the trailing edge of the sheet P2 has already passed the upstream detecting position at a time point when the leading edge of sheet P2 reaches the downstream detecting position.

Figure 4B:
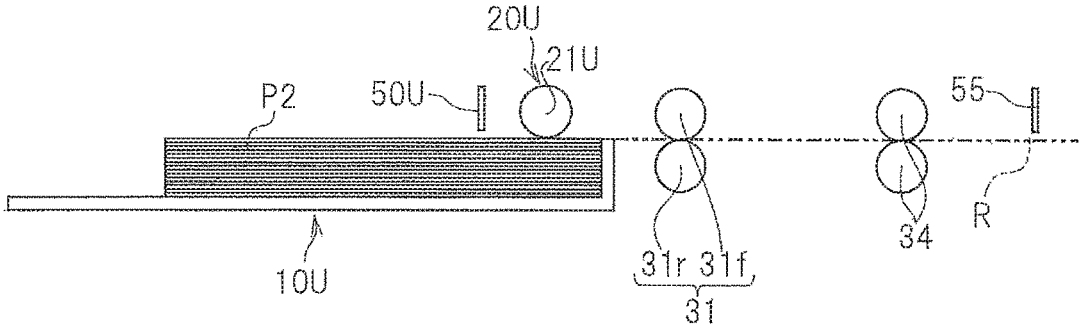
Figure 4C:
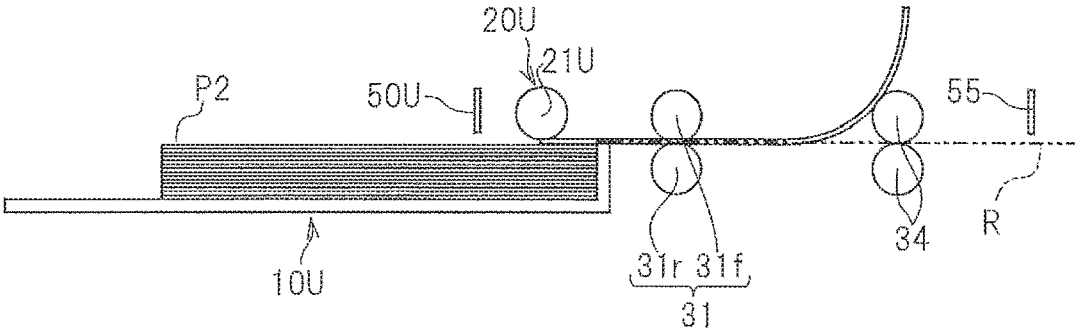
Figure 4D:
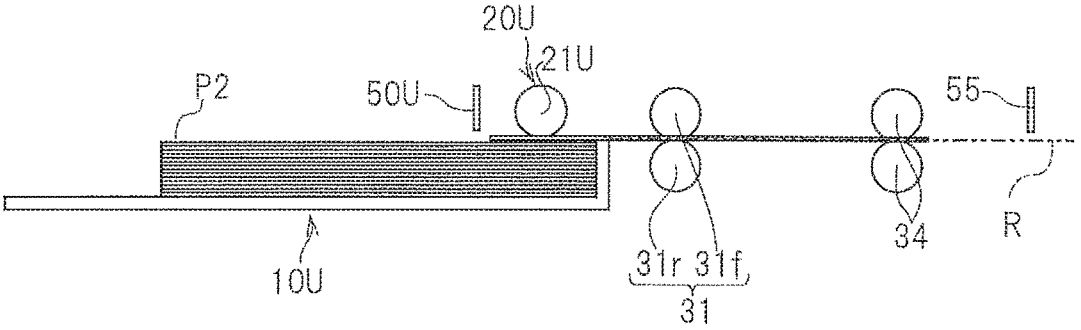

As shown in FIGS. 4B-4D, when the conveyance error of the sheet P2 occurs, the leading edge of the sheet P2 has not yet reached the downstream detecting position at the error determining time point. If the trailing edge of the sheet P2 has not yet passed the upstream detecting position at the error determining time point, the sheet P2 is still stored in the sheet-supply tray 10U, a shown in FIG. 4B. Accordingly, when the CPU 101 determines at the error determining time point, based on the detection result of the sheet remaining-amount detecting sensor 50U, that the trailing edge of the sheet P2 which was in contact with the pickup roller 21U at the time of initiation of the feeding operation has not yet passed the upstream detecting position, the CPU 101 identifies that the conveyance error of the sheet P2 is due to the feeding failure (FIG. 5). In this respect, there may be a case in which the leading edge of the sheet P2 has actually moved from the sheet-supply tray 10U onto the conveyance path R by being fed by the feeding mechanism 20U. Even in such a case, the sheet P2 is still in contact with the pickup roller 21U. Therefore, it is not problematic to identify that the conveyance error is due to the feeding failure.

On the other hand, if the trailing edge of the sheet P2 has passed the upstream detecting position at the error determining time point, this means that the sheet P2 is present between the upstream detecting position and the downstream detecting position. Because the sheet length of the sheet P2 is less than the sensor-to-sensor distance, there are a possibility that the sheet P2 is suffering from flexure or bending due to the jam (FIG. 4C) and a possibility that the sheet P2 is located more downstream in the conveyance direction due to the slippage, as compared with an intended position (FIG. 4D). Accordingly, when the CPU 101 determines at the error determining time point, based on the detection result of the sheet remaining-amount detecting sensor 50U, that the trailing edge of the sheet P2 has already passed the upstream detecting position, the CPU 101 identifies that the conveyance error of the sheet P2 is due to one of the jam and the slippage (FIG. 5).

When the CPU 101 determines at the error determining time point that, the trailing edge of the sheet P2 has already passed the upstream detecting position, the CPU101 executes a details identifying processing for identifying to which one of the jam and the slippage the conveyance error of the sheet P2 is attributable. Specifically, the CPU 101 continues conveyance of the sheet P2 by the conveyor mechanism 30 even after the error determining time point until a second time elapses from the time point of initiation of the feeding operation. Here, the second time is a sum of the first time and a delay time by which conveyance is assumed to be delayed due to the slippage between the conveyor mechanism 30 and the sheet P2. That is, the second time is a time which is longer than the first time and which is used when it is assumed the slippage is occurring. The second time is obtained by first dividing the conveyance distance from the sheet-supply tray 10U to the downstream detecting position by a conveyance speed assumed when the slippage is occurring and then adding the margin described above. In an instance where a possibility of occurrence of the slippage between the conveyance roller pair 34 and the sheet P is lower than a possibility of occurrence of the slippage between the separation roller pair 31 and the sheet P, it may assume that the slippage occurs only between the separation roller pair 31 and the sheet P. In this instance, there is calculated a difference between: a value obtained by dividing the conveyance distance from the sheet-supply tray 10U to the conveyance roller pair 34 by the conveyance speed of the sheet P by the separation roller pair 31 assumed when the slippage is occurring; and a value obtained by dividing the conveyance distance by the conveyance speed by the separation roller pair 31 in the normal condition. Subsequently, the difference is added to the first time, so as to obtain the second time.

As described above, in the case where the conveyance error is due to the slippage, the leading edge of the sheet P2 reaches the downstream detecting position in a time period from the time point of initiation of the feeding operation of the sheet P2 by the feeding mechanism 20U to a time point when the second time elapses. On the other hand, in the case where the conveyance error is due to the jam, the leading edge of the sheet P2 does not reach the downstream detecting position even after the second time has elapsed from the time point of initiation of the feeding operation of the sheet P2 by the feeding mechanism 20U.

Thus, based on the detection result of the sheet sensor 55, the CPU 101 identifies that the conveyance error is due to the slippage when it is determined that the leading edge of the sheet P2 has reached the downstream detecting position in the time period from the time point of initiation of the feeding operation of the sheet P2 by the feeding mechanism 20U to the time point when the second time elapses, and the CPU 101 identifies that the conveyance error is due to the jam when it is determined that the leading edge of the sheet P2 has not yet reached the downstream detecting position.

As explained above, the CPU 101 identifies, in the error-cause identifying processing, the cause of the conveyance error based on the spacing distance between the upstream detecting position of the sheet remaining-amount detecting sensor 50U and the downstream detecting position of the sheet sensor 55 in the conveyance direction, the sheet length of the sheet P stored in the sheet-supply tray 10U, and the detection result of the sheet remaining-amount detecting sensor 50U.

In the present embodiment, prior to execution of the error-cause identifying processing, the medium-length obtaining processing for obtaining the sheet length of the sheet P stored in the sheet-supply tray 10U is executed, and the obtained sheet length is stored in the nonvolatile memory 104. In the present embodiment, the printing command output from the external device 60 via a printer driver contains sheet size information on the sheet length of the sheet P stored in the sheet-supply tray 10U. The CPU 101 obtains the sheet length of the sheet P stored in the sheet-supply tray 10U, based on the printing command received from the external device 60. The sheet length of the sheet P may be obtained otherwise. For instance, the sheet length may be obtained from the user through the touch panel 4. Alternatively, there may be provided a sensor capable of detecting the sheet length of the sheet P stored in the sheet-supply tray 10U, and the sheet length may be obtained based on the detection result of the sensor.

The upstream detecting position of the sheet remaining-amount detecting sensor 50U and the downstream detecting position of the sheet sensor 55 are fixed. Thus, the sensor-to-sensor distance is pre-stored in the nonvolatile memory 104.

The identifying method explained above is for identifying the cause of the conveyance error of the sheet P fed from the upper sheet-supply tray 10U. This identifying method is similar to an identifying method for identifying the conveyance error of the sheet P fed from the lower sheet-supply tray 10D. In the latter identifying method, however, the sheet length of the sheet P stored in the sheet-supply tray 10D is obtained in the medium-length obtaining processing. Further, the cause of the conveyance error of the sheet P fed from the sheet-supply tray 10D is identified based on the obtained sheet length of the sheet P fed from the sheet-supply tray 10D, the spacing distance (sensor-to-sensor distance) between the upstream detecting position of the sheet remaining-amount detecting sensor 50D and the downstream detecting position of the sheet sensor 55, and the detection result of the sheet remaining-amount detecting sensor 50D. Thus, it is possible to accurately identify the cause of the conveyance error of the sheet P stored in the upper sheet-supply tray 10U and the cause of the conveyance error stored in the lower sheet-supply tray 10D.

Operations of Ink-Jet Printer

Figure 7:
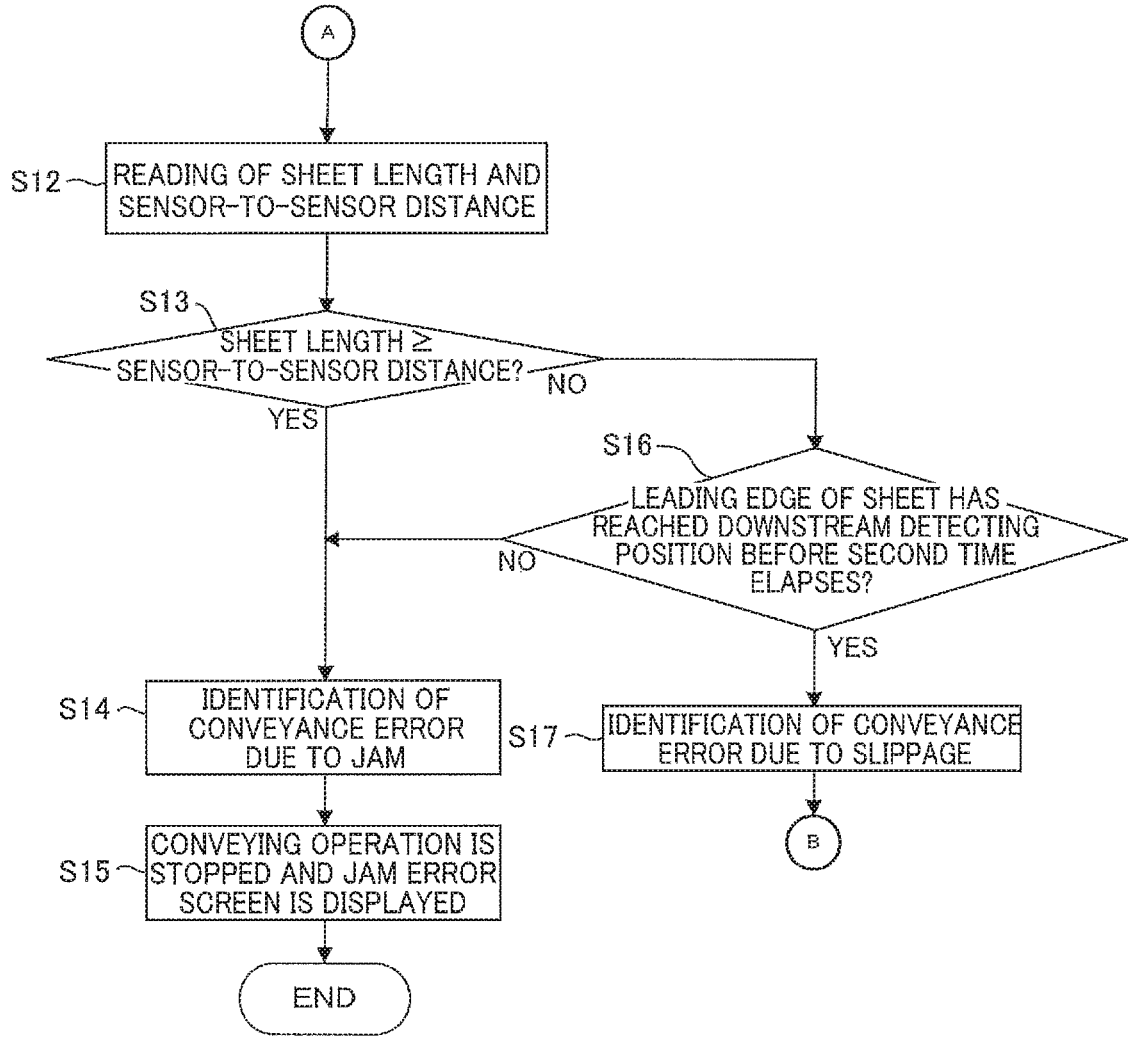
FIG. 7 is a flow chart for explaining an operation of the ink-jet printer.

Referring next to FIGS. 6 and 7, there will be explained one example of operations of the printer 1.

When a printing command is received from the external device 60 as shown in FIG. 6 (S1: YES), the CPU 101 determines a sheet-supply tray as a supply source (source tray) of the sheet P in accordance with the printing command, obtains, based on sheet size information contained in the printing command, the sheet length of the sheet P stored in the sheet-supply tray as the supply source, and stores the obtained sheet length in the nonvolatile memory 104. (S2: medium-length obtaining processing). For the sake of convenience, the following explanation will be made based on the assumption that the CPU 101 determines the sheet-supply tray 10U as the source tray.

Next, the CPU 101 controls the feeding mechanism 20U to perform the feeding operation to feed the sheet P from the sheet-supply tray 10U to the conveyance path R and controls the conveyor mechanism 30 to perform the conveying operation to convey the sheet P fed by the feeding mechanism 20U along the conveyance path R (S3: conveying processing). At the time point when the first time elapses from the time point of initiation of the feeding operation of the sheet P by the feeding mechanism 20U, the CPU 101 determines, based on the detection result of the sheet sensor 55, whether the leading edge of the sheet P has reached the downstream detecting position (S4: first determining processing). When it is determined that the leading edge of the sheet P has reached the downstream detecting position (S4: YES), the CPU 101 determines that no conveyance error occurs and determines whether printing based on the printing command is ended (S5). When it is determined that printing is ended (S5: YES), the processing operations are ended. On the other hand, when it is determined that printing is not ended (S5: NO), the control flow returns to S3 for feeding a next sheet P from the sheet-supply tray 10U to the conveyance path R.

When it is determined at S4 that the leading edge of the sheet P has not yet reached the downstream detecting position (S4: NO), the CPU 101 determines that the conveyance error is occurring (S6: error determining processing). The CPU 101 then determines, based on the detection result of the sheet remaining-amount detecting sensor 50U, whether the trailing edge of the sheet P that was in contact with the pickup roller 21U at the time point of initiation of the feeding operation has passed the upstream detecting position (S7: second determining processing). When it is determined that the trailing edge of the sheet P has not yet passed the upstream detecting position (S7: NO), the CPU 101 identifies that the conveyance error is due to the feeding failure (S8).

Next, the CPU 101 refers to the retry counter 104*a* of the nonvolatile memory 104 so as to determine whether the number of retries of the feeding operation is less than a predetermined number of times (e.g., five times) (S9). When it is determined that the number of retries of the feeding operation is less than the predetermined number of times (S9: YES), the number of retries stored in the retry counter 104*a* is incremented by one (S10), and the control flow returns to S3 for retrying the feeding operation. On the other hand, when it is determined that the number of retries has already reached the predetermined number of times (S9: NO), the CPU 101 determines that the feeding mechanism 20U is suffering from a mechanical malfunction and displays, on the touch panel 4, an error screen indicating the feeding failure (S11), so as to end the processing operations. The number of retries stored in the retry counter 104*a* may be initialized or reset to zero when the feeding operation by the feeding mechanism 20U has succeeded, namely, when the leading edge of the sheet P has reached the downstream detecting position. Further, the number of retries stored in the retry counter 104*a* may be initialized or reset to zero based on an input made by the user through the touch panel 4 or the like.

When it is determined at S7 that the trailing edge of the sheet P has passed the upstream detecting position (S7: YES) as shown in FIG. 7, the CPU 101 reads, from the nonvolatile memory 104, the sheet length of the sheet stored in the sheet-supply tray 10U and the sensor-to-sensor distance between the upstream detecting position of the sheet remaining-amount detecting sensor 50U and the downstream detecting position of the sheet P by the sheet sensor 55 (S12). The CPU 101 determines whether the sheet length is equal to or larger than the sensor-to-sensor distance (S13). When it is determined that the sheet length is equal to or larger than the sensor-to-sensor distance (S13: YES), the CPU 101 identifies that the conveyance error is due to the jam (S14). In this instance, the CPU 101 stops conveyance of the sheet P by the conveyor mechanism 30 and displays, on the touch panel 4, an error screen indicating the jam (S15), so as to end the processing operations.

When it is determined that the sheet length is less than the sensor-to-sensor distance (S13: NO), the CPU 101 identifies that the conveyance error is due to one of the jam and the slippage. For identifying to which one of the jam and the slippage the conveyance error is attributable, the CPU 101 determines, at the time point when the second time elapses from the time point of initiation of the feeding operation of the sheet P by the feeding mechanism 20U, whether the leading edge of the sheet P has reached the downstream detecting position, based on the detection result of the sheet sensor 55 (S16: third determining processing). When it is determined that the leading edge of the sheet P has not yet reached the downstream detecting position (S16: NO), the CPU 101 identifies that the conveyance error is due to the jam (S14), and the control flow goes to S15.

On the other hand, when it is determined that the leading edge of the sheet P has reached the downstream detecting position (S16: YES), the CPU 101 identifies that the conveyance error is due to the slippage (S17), and the control flow goes to S5. When going to S5, the sheet P has already reached the downstream detecting position. Thus, even if another sheet P following the sheet P in question is successively fed by the feeding mechanism 20U, the distance between the sheet P in question and the successively fed another sheet P does not become short, so that a necessary sheet-to-sheet distance is ensured. The processing operations of the printer 1 have been explained.

According to the present embodiment, when it is determined that the conveyance error is occurring, the CPU 101 identifies to which one of the jam, the slippage, and the feeding failure the conveyance error is attributable, based on the detection result of the sheet sensor 55, the detection result of the sheet remaining-amount detecting sensor 50U, 50D, and the comparison between the sheet length of the sheet P stored in the sheet-supply tray 10U, 10D and the sensor-to-sensor distance.

When the CPU 101 identifies that the conveyance error is due to the jam, the CPU 101 stops conveyance of the sheet P by the conveyor mechanism 30, thereby preventing the jam becoming worse. When the CPU 101 identifies that the conveyance error is due to the slippage, the CPU 101 continues conveyance of the sheet P by the conveyor mechanism 30, thereby preventing the sheet P from being unnecessarily stopped. When the CPU 101 identifies that the conveyance error is due to the feeding failure, the CPU 101 permits the feeding mechanism 20U, 20D to retry the feeding operation of the sheet P, thereby enabling the sheet P to be reliably conveyed to the conveyance path R.

In the illustrated embodiment, the feeding mechanism 20U, 20D corresponds to "feeder", and the separation roller pair 31, 32 and the conveyance roller pair 33, 34 correspond to "conveyor". The sheet remaining-amount detecting sensor 50U, 50D corresponds to "upstream sensor", and the sheet sensor 55 corresponds to "downstream sensor". The first time corresponds to "first predetermined time", "second predetermined time", and "third predetermined time". The second time corresponds to "third predetermined time". The touch panel 4 corresponds to "receiver".

There will be next explained a modified embodiment. In the illustrated embodiment, the CPU 101 identifies that the conveyance error is due to the jam when it is determined at S13 that the sheet length of the sheet P stored in the sheet-supply tray 10U is equal to or larger than the sensor-to-sensor distance. In an instance where there is substantially no difference between the value of the sheet length of the sheet P stored in the nonvolatile memory 104 and the value of the sensor-to-sensor distance, the actual cause of the conveyance error may be sometimes the slippage even when the CPU101 determines at S13 that the sheet length is equal to or larger than the sensor-to-sensor distance. The reasons will be explained below.

There may be a case in which the value of the sensor-to-sensor distance stored in the nonvolatile memory 104 differs from an actual sensor-to-sensor distance value, due to an error in mounting the sheet remaining-amount detecting sensors 50U, 50D or an error in mounting the sheet sensor 55. Further, the sheet length of the sheet P stored in the sheet-supply tray 10U, 10D has some variations, so that the value of the sheet length obtained based on the sheet size information contained in the printing command may differ from an actual sheet length value. Accordingly, even if the sheet length stored in the nonvolatile memory 104 is equal to or larger than the sensor-to-sensor distance, the actual sheet length may sometimes be less than the sensor-to-sensor distance.

In an instance where the sheet P has low resilience, the sheet P is conveyed by the conveyor mechanism 30 while being somewhat bent or flexed. Accordingly, if the sheet has low resilience even though the sheet length is somewhat larger than the sensor-to-sensor distance, there may be a possibility that none of the sheet sensor 55 and the sheet remaining-amount detecting sensors 50U, 50D can detect the presence of the sheet P at the error determining time point, despite that the jam is not occurring.

For the reasons above, there may be a possibility that the CPU 101 erroneously identifies that the conveyance error is due to the jam, despite that the actual cause of the conveyance error is the slippage. As a solution to such a problem, instead of using the sensor-to-sensor distance as the distance to be compared with the sheet length stored in the nonvolatile memory 104 at S13, there may be used a predetermined length which is longer by an amount corresponding to a margin in consideration of the errors described above. This solution reduces the possibility that the CPU 101 erroneously identifies that the conveyance error is due to the jam, despite that the actual cause of the conveyance error is the slippage.

According to the above solution, however, the CPU 101 is required to execute the details identifying processing described above for identifying to which one of the jam and the slippage the conveyance error is attributable, even in a case in which the sheet length stored in the nonvolatile memory 104 is less than the predetermined length and is equal to or larger than the sensor-to-sensor distance. That is, conveyance of the sheet P by the conveyor mechanism 30 needs to be continued until the second time elapses from the time point of initiation of the feeding operation of the sheet P by the feeding mechanism 20U. In this case, the jam may become worse if the actual cause of the conveyance error is the jam. In addition, it is not possible to identify closely the cause of the conveyance error unless the second time elapses from the time point of initiation of the feeding operation. In this case, it takes a longer time to identify the cause of the conveyance error. In the following explanation, the details identifying processing executed in the case where the sheet length stored in the nonvolatile memory 104 is less than the predetermined length and is equal to or larger than the sensor-to-sensor distance is defined as a first details identifying processing. The details identifying processing executed in the case where the sheet length is less than the sensor-to-sensor distance is defined as a second details identifying processing.

A case is considered in which a difference between the value of the sheet length stored in the nonvolatile memory 104 and the actual sheet length value is small, a difference between the value of the sensor-to-sensor distance stored in the nonvolatile memory 104 and the actual sensor-to-sensor distance value is small, and the sheet P stored in the sheet-supply tray 10U, 10D has high resilience. In this case, if none of the sheet sensor 55 and the sheet remaining-amount detecting sensors 50U, 50D can detect the presence of the sheet P at the error determining time point, the possibility that the jam is the cause of the conveyance error is significantly higher than the possibility that the slippage is the cause of the conveyance error. That is, in this case, there is a significantly high possibility that the CPU 101 determines in the first details identifying processing that the conveyance error is due to the jam. Thus, in an instance where there are many identification results that the CPU 101 determined in the previously executed first details identifying processings that the conveyance error is due to the jam, it is possible to identify that the conveyance error is due to the jam without executing the first details identifying processing.

Figure 8:
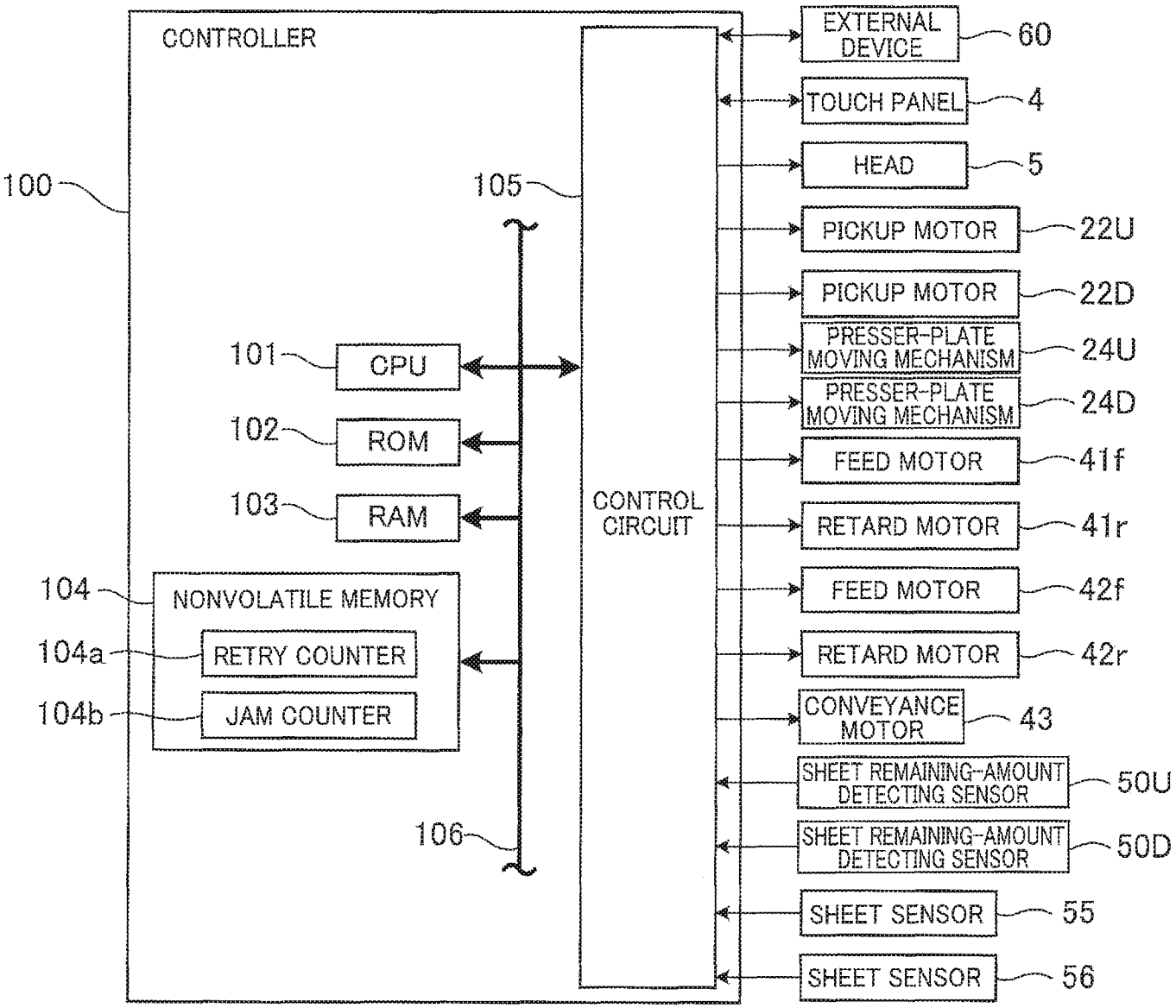
FIG. 8 is a view showing an electrical configuration of an ink-jet printer according to one modified embodiment.

In the modified embodiment, therefore, the nonvolatile memory 104 includes a jam counter 104*b* for storing a number of times of jams, as shown in FIG. 8. This number of times of jams is a number of times by which the CPU 101 identified in the previously executed first details identifying processings that the conveyance error was due to the jam. In other words, the number of times of jams is error information on the cause of the previous conveyance error.

When the CPU 101 determines in the error-cause identifying processing that the trailing edge of the sheet P has not yet passed the upstream detecting position and the sheet length stored in the nonvolatile memory 104 is less than the predetermined length and is equal to or larger than the sensor-to-sensor distance, the CPU 101 executes a jam determining processing. In the jam determining processing, the CPU 101 determines whether it is possible to identify, based on the number of times of jams stored in the jam counter 104*b*, whether the conveyance error is due to the jam. Specifically, when the number of times of jams has already reached a predetermined threshold (e.g., five times), the CPU 101 determines that it is possible to identify that the conveyance error is due to the jam. On the other hand, when the number of times of jams is less than the threshold, the CPU 101 determines that it is not possible to identify that the conveyance error is due to the jam.

When it is determined that it is possible to identify that the conveyance error is due to the jam, the CPU 101 identifies that the conveyance error is due to the jam without executing the first details identifying processing described above, so that a time required for identifying the cause of the conveyance error can be reduced.

On the other hand, when the number of times of jams is less than the threshold, the CPU 101 determines that it is not possible to identify that the conveyance error is due to the jam. In this case, the CPU 101 executes the first details identifying processing. Specifically, at the time point when the second time elapses from the time point of initiation of the feeding operation of the sheet P by the feeding mechanism 20U, the CPU 101 determines, based on the detection result of the sheet sensor 55, whether the leading edge of the sheet P has reached the downstream detecting position. When it is determined that the leading edge of the sheet P has reached the downstream detecting position, the CPU 101 identifies that the conveyance error is due to the slippage. On the other hand, when it is determined that the leading edge of the sheet P has not yet reached the downstream detecting position, the CPU 101 identifies that the conveyance error is due to the jam. In this instance, the number of times of jams stored in the jam counter 104*b* is incremented by one when it is identified that the conveyance error is due to the jam. This arrangement facilitates identification to be made in subsequent jam determining processings that the conveyance error is due to the jam.

In the meantime, there may be a case in which the sheet length of the sheet P or the resilience of the sheet P is changed as a result of a change in the type of the sheet P stored in the sheet-supply tray 10U, 10D. In this case, the number of times of jams stored in the jam counter 104*b* does not match to the type of the sheet P stored in the sheet-supply tray 10U, 10D, so that there is a possibility that the error-cause identifying processing cannot be properly executed thereafter. In the present embodiment, therefore, the CPU 101 initializes or resets, to zero, the number of times of jams stored in the jam counter 104*b* based on an input made by the user through the touch panel 4. This configuration enables the error-cause identifying processing to be properly executed thereafter even when the type of the sheet P stored in the sheet-supply tray 10U, 10D is changed.

Figure 9:
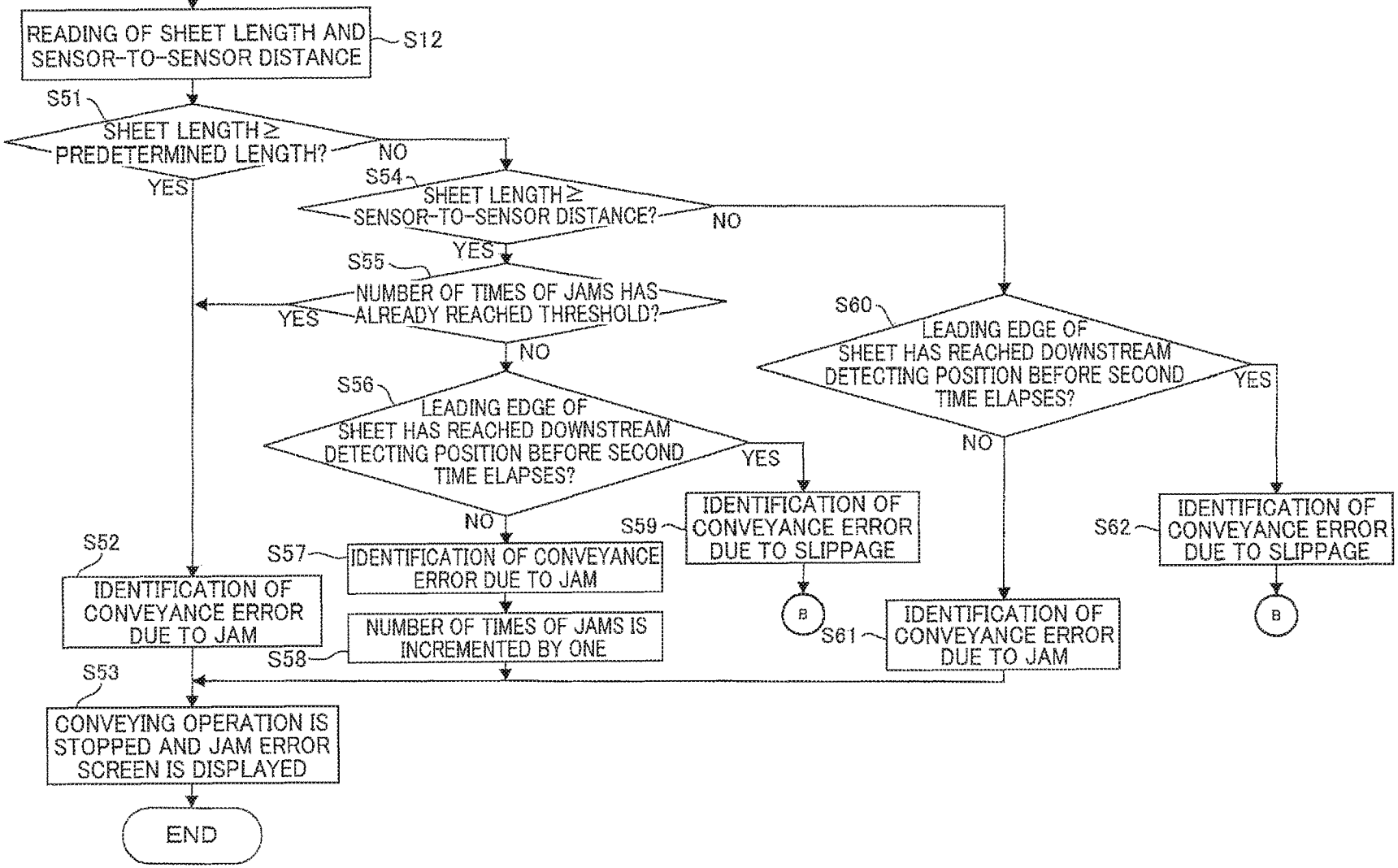
FIG. 9 is a flow chart for explaining an operation of the ink-jet printer according to the modified embodiment.

Referring next to FIG. 9, there will be explained one example of operations of the printer 1 according to the modified embodiment. The following explanation will be made focusing only on a part of the operations that differ from those of the printer 1 explained above with respect to FIGS. 6 and 7.

As shown in FIG. 9, after the CPU 101 reads the sheet length and the sensor-to-sensor distance from the nonvolatile memory 104 at S12, the CPU 101 determines whether the sheet length is equal to or larger than the predetermined length (S51). When the sheet length is equal to or larger than the predetermined length (S51: YES), the CPU 101 identifies that the conveyance error is due to the jam (S52). In this instance, the CPU 101 stops conveyance of the sheet P by the conveyor mechanism 30 and displays, on the touch panel 4, an error screen indicating the jam (S53), so as to end the processing operations.

On the other hand, when it is determined at S51 that the sheet length is less than the predetermined length (S51: NO), the CPU 101 determines whether the sheet length is equal to or larger than the sensor-to-sensor distance (S54). When the sheet length is equal to or larger than the sensor-to-sensor distance (S54: YES), the CPU 101 determines whether the number of times of jams stored in the jam counter 104*b* has already reached the threshold (S55). When it is determined that the number of times of jams has already reached the threshold (S55: YES), the CPU 101 determines that the conveyance error is due to the jam (S52), and the control flow goes to S53.

On the other hand, when it is determined that the number of times of jams is less than the threshold (S55: NO), the CPU 101 determines, at the time point when the second time elapses from the time point of initiation of the feeding operation of the sheet P by the feeding mechanism 20U, whether the leading edge of the sheet P has reached the downstream detecting position, based on the detection result of the sheet sensor 55 (S56). When it is determined that the leading edge of the sheet P has not yet reached the downstream detecting position (S56: NO), the CPU 101 identifies that the conveyance error is due to the jam (S57). In this case, the CPU 101 executes updating of the number of times of jams stored in the jam counter 104*b* such that the number of times of jams is incremented by one (S58: updating processing), and the control flow goes to S53. On the other hand, when it is determined that the leading edge of the sheet P has reached the downstream detecting position (S56: YES), the CPU 101 determines that the conveyance error is due to the slippage (S59), and the control flow goes to S5.

When it is determined at S54 that the sheet length is less than the sensor-to-sensor distance (S54: NO), the CPU 101 determines, at the time point when the second time elapses from the time point of initiation of the feeding operation of the sheet P by the feeding mechanism 20U, whether the leading edge of the sheet P has reached the downstream detecting position, based on the detection result of the sheet sensor 55 (S60: fourth determining processing). When it is determined that the leading edge of the sheet P has not yet reached the downstream detecting position (S60: NO), the CPU 101 identifies that the conveyance error is due to the jam (S61), and the control flow goes to S53. On the other hand, when it is determined that the leading edge of the sheet P has reached the downstream detecting position (S60: YES), the CPU 101 identifies that the conveyance error is due to the slippage (S61), and the control flow goes to S5.

The processing operations of the printer 1 according to the modified embodiment have been explained.

According to the modified embodiment, it is possible to more accurately identify to which one of the jam and the slippage the conveyance error is attributable. Further, the number of times of jams used in the jam determining processing is information to be updated by reflecting the result of identification made in the first details identifying processing that the conveyance error is due to the jam. Thus, the jam determining processing can be accurately executed. Moreover, the jam determining processing can be executed by a simple method, i.e., comparison between the number of times of jams and the threshold.

In the modified embodiment, the error information stored in the nonvolatile memory 104 and used in the jam determining processing is the number of times of jams. The error information is not necessarily limited to the number of times jams, but may be any information as long as the information is updated so as to facilitate, in the jam determining processing, identification that the conveyance error is due to the jam, based on the identification result made in the first details identifying processing. For instance, the error information may be a ratio of identification that the conveyance error is due to the jam in a plural number of previously executed first details identifying processings. In this instance, when the ratio exceeds a predetermined threshold, it is possible to identify in the jam determining processing determine that the conveyance error is due to the jam.

While the preferred embodiment and the modified embodiment have been explained above, the disclosure is not limited to the details of the embodiments but may be embodied with various other changes without departing from the scope defined in the attached claims. For instance, while the printer 1 includes the two sheet-supply trays 10U, 10D in the illustrated embodiments, the printer 1 may include only one sheet-supply tray or three or more sheet-supply trays.

In the illustrated embodiments, the determination of the conveyance error is made by the CPU 101 based on the detection signal of the sheet sensor 55. The determination of the conveyance error may be made based on the detection signal of the sheet sensor 56 used in determination of the start timing of ink ejection, for instance.

The conveyor mechanism 30 conveys the sheet P by the conveyance roller pairs. The sheet P may be conveyed by a conveyor belt. In the illustrated embodiments, the feeding mechanism 20U, 20D is configured to contact the uppermost one of the sheets P stored in the sheet-supply tray 10U, 10D and to feed the uppermost sheet P to the conveyance path R. The feeding mechanism 20U, 20D may be configured co contact a lowermost one of the sheets P and to feed the lowermost sheet P to the conveyance path R. In this instance, the upstream detecting position of each of the sheet remaining-amount detecting sensors 50U, 50D is a storage position of the lowermost one of the sheets P stored in the corresponding sheet-supply tray 10U, 10D.

Figure 10:
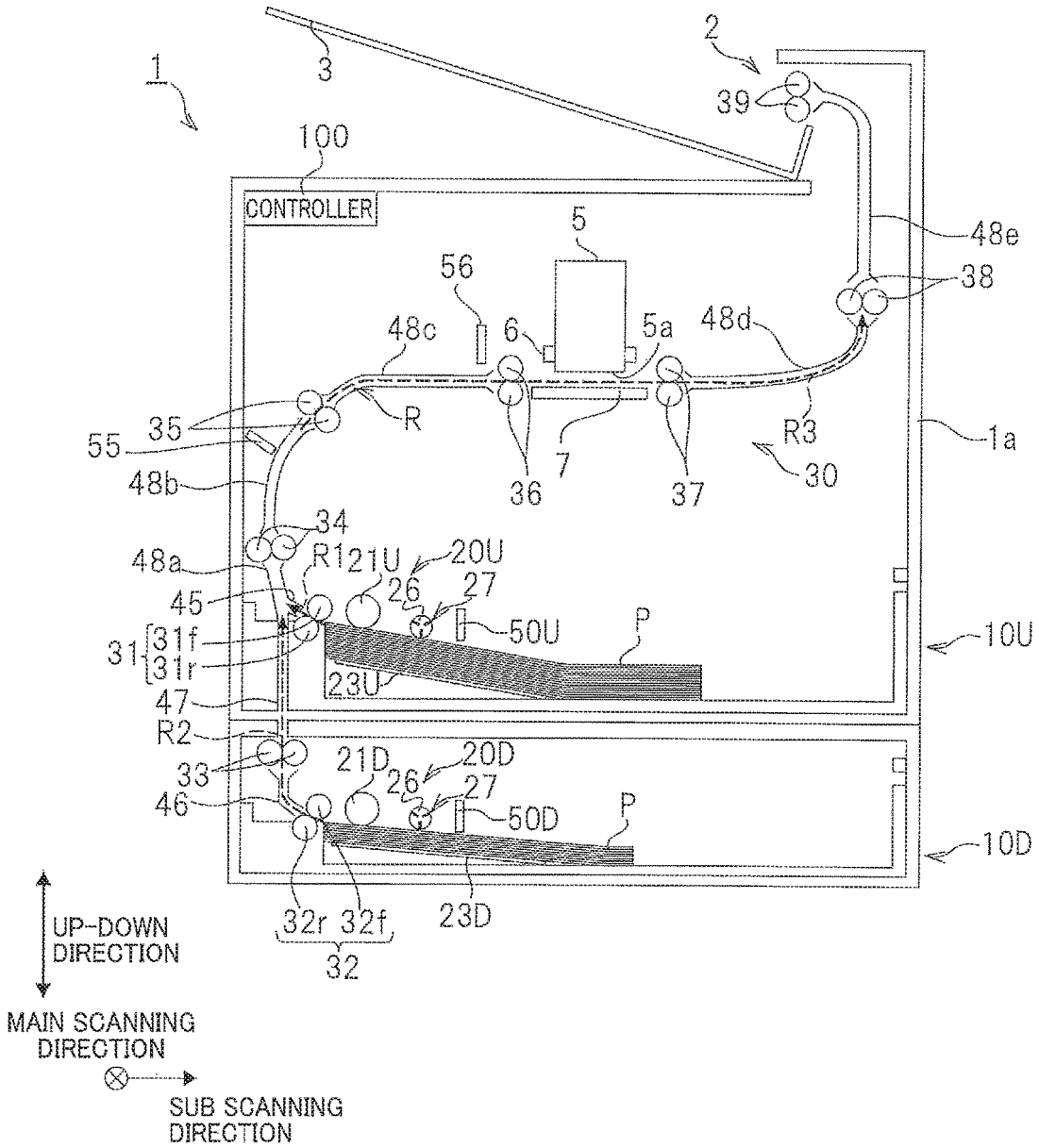
FIG. 10 is a side view schematically showing a mechanical configuration of an ink-jet printer according to another modified embodiment.

There may be provided sensors for detecting presence or absence of the sheet P at the upstream detecting position, in addition to the sheet remaining-amount detecting sensors 50U, 50D. Referring to FIG. 10, one example of this modified embodiment will be explained. In this modified embodiment shown in FIG. 10, the printer 1 further includes: driven rollers 26 each contacting the uppermost sheet P stored in a corresponding one of the sheet-supply trays 10U, 10D; and sensors 27 each for detecting presence or absence of rotation of a corresponding one of the driven rollers 26. For the sake of convenience, the driven rollers 26 and the sensors 27 will be collectively referred to as the driven roller 26 and the sensor 27, respectively, where appropriate.

The driven roller 26 is configured to rotate in accordance with feeding (movement) of the uppermost sheet P by the feeding mechanism 20U, 20D while being in contact with the uppermost sheet P. Thus, the driven roller 26 stops rotating when the uppermost sheet P is fed by the feeding mechanism 20U, 20D and the trailing edge of the sheet P no longer contacts the driven roller 26.

The sensor 27 is configured to detect presence or absence of the uppermost sheet P at a contact position of the uppermost sheet P and the driven roller 26 as the upstream detecting position. The sensor 27 detects presence of the sheet P at the upstream detecting position during a time period in which the driven roller 26 is rotating from the time point of initiation of the feeding operation by the feeding mechanism 20U, 20D. The sensor 27 detects absence of the sheet P at the upstream detecting position when the driven roller 26, which was rotating, stops. In a case where the failure of feeding of the sheet P by the feeding mechanism 20U, 20D is occurring, the driven roller 26 does not rotate even after the feeding operation by the feeding mechanism 20U, 20D is initiated. In such case, the sensor 27 detects presence of the sheet P at the upstream detecting position.

Also in this modified embodiment, the controller 100 can determine whether the trailing edge of the uppermost sheet P has passed the upstream detecting position, based on the detection result of the sensor 27.

In the configuration in which the controller 100 determines whether the trailing edge of the sheet P has passed the upstream detecting position based on the detection result of the sheet remaining-amount detecting sensor 50U, 50D, the sheet remaining-amount detecting sensor 50U, 50D needs to detect that the distance to the target object is changed by an amount corresponding to the thickness of one sheet P. In this case, the sheet remaining-amount detecting sensor 50U, 50D needs to have high performance, resulting in an increase of the cost of the sheet remaining-amount detecting sensor 50U, 50D. In a case where the accuracy of positioning the presser plate 23U, 23D by the presser-plate moving mechanism 24U, 24D is low and an error between a control target position and an actual position is not smaller than the thickness of one sheet P, for instance, there is a possibility that the controller 100 cannot accurately determine whether the trailing edge of the sheet P has passed the upstream detecting position even if the sheet remaining-amount detecting sensor 50U, 50D has high performance.

In this modified embodiment, in contrast, the controller 100 determines whether the trailing edge of the sheet P has passed the upstream detecting position based on the detection result of the sensor 27 configured to detect presence or absence of rotation of the driven roller 26 that rotates in accordance with feeding of the uppermost sheet P. Accordingly, the controller 100 can make the determination more accurately. Moreover, it is merely required for the sensor 27 to detect only presence or absence of rotation of the driven roller 26, so that a relatively inexpensive sensor can be employed as the sensor 27. The sensor 27 may be configured to detect a conveyed amount (movement amount) of the uppermost sheet P, based on the rotation amount of the driven roller 26. In this instance, it is possible to accurately determine the conveyed position of the sheet P after the feeding mechanism 20U, 20D has initiated the feeding operation of the uppermost sheet P. It is thus possible to more accurately determine whether the failure of feeding of the sheet P by the feeding mechanism 20U, 20D is occurring.

In the illustrated embodiments, the conveyor apparatus according to the present disclosure is applied to the ink-jet printer as one example of the image recording apparatus. The conveyor apparatus according to the present disclosure is applicable to various apparatus configured to convey the recording medium. For instance, the conveyor apparatus according to the present disclosure is applicable to the image recording apparatus such as a laser printer or a thermal printer, other than the ink-jet printer.

What is claimed is:

1. A conveyor apparatus, comprising:

a tray configured to store a plurality of recording media;

a feeder configured to contact an uppermost recording medium among the plurality of recording media stored in the tray and configured to feed the uppermost recording medium to a conveyance path;

a conveyor configured to convey, along the conveyance path, the uppermost recording medium fed by the feeder;

an upstream sensor configured to detect presence or absence of the uppermost recording medium at an upstream detecting position in a conveyance direction of the uppermost recording medium, the upstream detecting position being a storage position of the uppermost recording medium among the plurality of recording media stored in the tray which is held in contact with the feeder;

a downstream sensor configured to detect presence or absence of the conveyed uppermost recording medium at a downstream detecting position which is downstream of the conveyor in the conveyance direction; and a controller configured to:

obtain a length of the uppermost recording medium stored in the tray in the conveyance direction;

determine, when an uppermost recording medium fed to the conveyance path by the feeder is conveyed along the conveyance path, based on a detection result of the downstream sensor, whether the uppermost recording medium has reached the downstream detecting position in a time period from a time point of initiation of a feeding operation of the uppermost recording medium by the feeder to a time point when a first predetermined time elapses; and determine, based on a detection result of the upstream sensor, whether a trailing edge of the uppermost recording medium in the conveyance direction has passed the upstream detecting position, wherein when it is determined that the uppermost recording medium has not yet reached the downstream detecting position at the time point when the first predetermined time elapses and it is determined that the trailing edge of the uppermost recording medium has passed the upstream detecting position, the controller is configured to determine whether the obtained medium length is equal to or larger than a spacing distance in the conveyance direction between the upstream detecting position and the downstream detecting position, and wherein the controller determines that a conveyance error of the uppermost recording medium is due to one of: (i) a jam of the uppermost recording medium occurred in the conveyance path; and (ii) a slippage caused between the conveyor and the uppermost recording medium when it is determined that the obtained medium length is less than the spacing distance while the controller determines that the conveyance error of the uppermost recording medium is due to the jam when it is determined that the obtained medium length is equal to or larger than the spacing distance.

2. The conveyor apparatus according to claim 1, wherein the controller controls the conveyor to stop conveyance of the uppermost recording medium when the conveyance error of the uppermost recording medium is due to the jam while the controller controls the conveyor to continue conveyance of the uppermost recording medium when the conveyance error is due to the slippage.

3. The conveyor apparatus according to claim 1, wherein when it is determined that the trailing edge of the uppermost recording medium has not yet passed the upstream detecting position, the controller determines that the conveyance error of the uppermost recording medium is due to a failure of feeding of the uppermost recording medium by the feeder.

4. A conveyor apparatus, comprising:

a tray configured to store a plurality of recording media;

a feeder configured to contact an uppermost recording medium among the plurality of recording media stored in the tray and configured to feed the uppermost recording medium to a conveyance path;

a conveyor configured to convey, along the conveyance path, the uppermost recording medium fed by the feeder;

an upstream sensor configured to detect presence or absence of the uppermost recording medium at an upstream detecting position in a conveyance direction of the uppermost recording medium, the upstream detecting position being a storage position of the uppermost recording medium among the plurality of recording media stored in the tray which is held in contact with the feeder;

a downstream sensor configured to detect presence or absence of the conveyed uppermost recording medium at a downstream detecting position which is downstream of the conveyor in the conveyance direction; and a controller configured to:

obtain a length of the uppermost recording medium stored in the tray in the conveyance direction;

determine, when the uppermost recording medium fed to the conveyance path by the feeder is conveyed along the conveyance path, based on a detection result of the downstream sensor, whether the uppermost recording medium has reached the downstream detecting position in a time period from a time point of initiation of a feeding operation of the uppermost recording medium by the feeder to a time point when a first predetermined time elapses; and determine, based on a detection result of the upstream sensor, whether a trailing edge of the uppermost recording medium in the conveyance direction has passed the upstream detecting position, wherein when it is determined that the uppermost recording medium has not yet reached the downstream detecting position at the time point when the first predetermined time elapses and it is determined that the trailing edge of the uppermost recording medium has passed the upstream detecting position, the controller determines that a conveyance error of the uppermost recording medium is due to one of (i) a jam of the uppermost recording medium occurred in the conveyance path; and (ii) a slippage caused between the conveyor and the uppermost recording medium if the obtained medium length is less than a spacing distance in the conveyance direction between the upstream detecting position and the downstream detecting position while the controller determines that the conveyance error of the uppermost recording medium is due to the jam if the obtained medium length is equal to or larger than the spacing distance, wherein when it is determined that the uppermost recording medium has not yet reached the downstream detecting position at the time point when the first predetermined time elapses, it is determined that the trailing edge of the uppermost recording medium has passed the upstream detecting position, and the obtained medium length is less than the spacing distance, the controller is further configured to determine whether the uppermost recording medium has reached the downstream detecting position in a time period from the time point of initiation of the feeding operation of the uppermost recording medium by the feeder to a time point when a second predetermined time longer than the first predetermined time elapses, wherein when it is determined that the uppermost recording medium has reached the downstream detecting position in the time period from the time point of initiation of the feeding operation of the uppermost recording medium by the feeder to the time point when the second predetermined time elapses, the controller determines that the conveyance error of the uppermost recording medium is due to the slippage, and wherein when it is determined that the uppermost recording medium has not yet reached the downstream detecting position at the time point when the second predetermined time elapses, the controller determines that the conveyance error of the uppermost recording medium is due to the jam.

5. A conveyor apparatus, comprising:

a tray configured to store a plurality of recording media;

a feeder configured to contact an uppermost recording medium among the plurality of recording media stored in the tray and configured to feed the uppermost recording medium to a conveyance path;

a conveyor configured to convey, along the conveyance path the uppermost recording medium fed by the feeder;

an upstream sensor configured to detect presence or absence of the uppermost recording medium at an upstream detecting position in a conveyance direction of the uppermost recording medium, the upstream detecting position being a storage position of the uppermost recording medium among the plurality of recording media stored in the tray which is held in contact with the feeder;

a downstream sensor configured to detect presence or absence of the conveyed uppermost recording medium at a downstream detecting position which is downstream of the conveyor in the conveyance direction; and a controller configured to:

obtain a length of the uppermost recording medium stored in the tray in the conveyance direction;

determine, when the uppermost recording medium fed to the conveyance path by the feeder is conveyed along the conveyance path, based on a detection result of the downstream sensor, whether the uppermost recording medium has reached the downstream detecting position in a time period from a time point of initiation of a feeding operation of the uppermost recording medium by the feeder to a time point when a first predetermined time elapses; and determine, based on a detection result of the upstream sensor, whether a trailing edge of the uppermost recording medium in the conveyance direction has passed the upstream detecting position, wherein when it is determined in that the uppermost recording medium has not yet reached the downstream detecting position at the time point when the first predetermined time elapses and it is determined that the trailing edge of the uppermost recording medium has passed the upstream detecting position, the controller determines that a conveyance error of the uppermost recording medium is due to one of: (i) a jam of the uppermost recording medium occurred in the conveyance path; and a slippage caused between the conveyor and the uppermost recording medium if the obtained medium length is less than a spacing distance in the conveyance direction between the upstream detecting position and the downstream detecting position, wherein the conveyor apparatus further comprises a storage, wherein the controller is configured to control the storage to store a number of times of jams, the number of times of jams being a number of at least one recording medium which was conveyed prior to conveyance of the uppermost recording medium by the conveyor and for which the controller determined that the conveyance error was due to the jam, and wherein the controller determines that the conveyance error of the uppermost recording medium is due to the jam when the number of times of jams stored in the storage is equal to or greater than a first value and when it is determined that the obtained medium length is equal to or larger than the spacing distance while the controller determines that the conveyance error of the uppermost recording medium is due to one of the jam and the slippage when the number of times of jams stored in the storage is less than the first value.

6. A conveyor apparatus, comprising:

a tray configured to store a plurality of recording media;

a feeder configured to contact an uppermost recording medium among the plurality of recording media stored in the tray and configured to feed the uppermost recording medium to a conveyance path;

a conveyor configured to convey, along the conveyance path, the uppermost recording medium fed by the feeder;

an upstream sensor configured to detect presence or absence of the uppermost recording medium at an upstream detecting position in a conveyance direction of the uppermost recording medium, the upstream detecting position being a storage position of the uppermost recording medium among the plurality of recording media stored in the tray which is held in contact with the feeder;

a downstream sensor configured to detect presence or absence of the conveyed uppermost recording medium at a downstream detecting position which is downstream of the conveyor in the conveyance direction; and a controller configured to:

obtain a length of the uppermost recording medium stored in the tray in the conveyance direction;

determine, when the uppermost recording medium fed to the conveyance path by the feeder is conveyed along the conveyance path, based on a detection result of the downstream sensor, whether the uppermost recording medium has reached the downstream detecting position in a time period from a time point of initiation of a feeding operation of the uppermost recording medium by the feeder to a time point when a first predetermined time elapses; and determine based on a detection result of the upstream sensor whether a trailing edge of the uppermost recording medium in the conveyance direction has passed the upstream detecting position, wherein when it is determined that the uppermost recording medium has not yet reached the downstream detecting position at the time point when the first predetermined time elapses and it is determined that the trailing edge of the uppermost recording medium has passed the upstream detecting position, the controller determines that a conveyance error of the uppermost recording medium is due to one of: (i) a jam of the uppermost recording medium occurred in the conveyance path; and (ii) a slippage caused between the conveyor and the uppermost recording medium if the obtained medium length is less than a spacing distance in the conveyance direction between the upstream detecting position and the downstream detecting position while the controller determines that the conveyance error of the uppermost recording medium is due to the jam if the obtained medium length is equal to or larger than the spacing distance, wherein the tray includes a first tray and a second tray, wherein the feeder includes: a first feeder configured to contact an uppermost recording medium among a plurality of recording media stored in the first tray and configured to feed the uppermost recording medium to a first conveyance path; and a second feeder configured to contact an uppermost recording medium among a plurality of recording media stored in the second tray and configured to feed the uppermost recording medium to a second conveyance path, wherein the conveyor includes: a first conveyor configured to receive the uppermost recording medium fed by the first feeder to the first conveyance path and to convey the received uppermost recording medium to a common conveyance path; and a second conveyor configured to receive the uppermost recording medium fed by the second feeder to the second conveyance path and to convey the received uppermost recording medium to the common conveyance path, wherein the upstream sensor includes: a first upstream sensor configured to detect presence or absence of a first recording medium as the uppermost recording medium conveyed by the first conveyor at a first upstream detecting position in a conveyance direction of the first recording medium, the first upstream detecting position being a storage position of the first recording medium among the plurality of recording media stored in the first tray which is held in contact with the first feeder; and a second upstream sensor configured to detect presence or absence of a second recording medium as the uppermost recording medium conveyed by the second conveyor at a second upstream detecting position in a conveyance direction of the second recording medium, the second upstream detecting position being a storage position of the second recording medium among the plurality of recording media stored in the second tray which is held in contact with the second feeder, wherein the downstream sensor is configured to detect presence or absence of the first recording medium or the second recording medium at a position on the common conveyance path as the downstream detecting position, wherein the controller is configured to obtain, a medium length of each of the first recording medium and the second recording medium, wherein the controller is configured to:

determine whether the first recording medium has reached the downstream detecting position in a time period from a time point of initiation of a feeding operation, by the first feeder, of the first recording medium conveyed to the first conveyance path to a time point when a second predetermined time elapses;

determine, based on a detection result of the first upstream sensor, whether a trailing edge of the first recording medium in the conveyance direction has passed the first upstream detecting position; and when it is determined that the first recording medium has not yet reached the downstream detecting position at the time point when the second predetermined time elapses and it is determined that the trailing edge of the first recording medium has passed the first upstream detecting position, the controller determines that a conveyance error of the first recording medium is due to one of: (i) a jam of the first recording medium occurred in one of the first conveyance path and the common conveyance path; and (ii) a slippage caused between the first conveyor and the first recording medium if the obtained medium length is less than a spacing distance between the first upstream detecting position and the downstream detecting position in the conveyance direction, and wherein the controller further configured to:

determine, whether the second recording medium has reached the downstream detecting position in a time period from a time point of initiation of a feeding operation, by the second feeder, of the second recording medium conveyed to the second conveyance path to a time point when a third predetermined time elapses;

determine, based on a detection result of the second upstream sensor, whether a trailing edge of the second recording medium in the conveyance direction has passed the second upstream detecting position; and when it is determined that the second recording medium has not yet passed the downstream detecting position at the time point when the third predetermined time elapses and it is determined that the trailing edge of the second recording medium has passed the second upstream detecting position, the controller determines that a conveyance error of the second recording medium is due to one of: (i) a jam of the second recording medium occurred in one of the second conveyance path and the common conveyance path; and (ii) a slippage caused between the second conveyor and the second recording medium if the obtained medium length is less than a spacing distance between the second upstream detecting position and the downstream detecting position in the conveyance direction.

* * * * *